US007545394B2

(12) United States Patent
Nose et al.

(10) Patent No.: US 7,545,394 B2
(45) Date of Patent: Jun. 9, 2009

(54) METHOD AND DRIVE SEQUENCE FOR TIME-DIVISIONALLY DRIVING A DISPLAY PANEL

(75) Inventors: Takashi Nose, Kanagawa (JP); Masahiro Toeda, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 691 days.

(21) Appl. No.: 11/094,765

(22) Filed: Mar. 31, 2005

(65) Prior Publication Data

US 2005/0219276 A1 Oct. 6, 2005

(30) Foreign Application Priority Data

Mar. 31, 2004 (JP) ..... 2004-105942

(51) Int. Cl.
*G09G 5/10* (2006.01)

(52) U.S. Cl. ..... 345/690; 345/100

(58) Field of Classification Search ..... 345/88–89, 345/98–100, 103, 694–697, 690, 691
See application file for complete search history.

(56) References Cited

U.S. PATENT DOCUMENTS 7,084,844 B2 * 8/2006 Yeo et al. ..... 345/88
7,209,111 B2 * 4/2007 Kurokawa et al. ..... 345/99
2002/0084966 A1 * 7/2002 Yeo ..... 345/88

FOREIGN PATENT DOCUMENTS

| | | |
|---|---|---|
| JP | 4-52684 | 2/1992 |
| JP | 2001-109435 | 4/2001 |
| JP | 2001-337657 | 12/2001 |

* cited by examiner

*Primary Examiner*—Chanh Nguyen
*Assistant Examiner*—Allison Walthall
(74) *Attorney, Agent, or Firm*—Young & Thompson

(57) ABSTRACT

A method is provided for driving a display panel including N×3 pixels arranged along each of a plurality of lines extending in a scanning line direction with N being an integer equal to or more than 2, the N×3 pixels constituting first to $N^{th}$ pixel sets each comprising an R pixel associated with red, a G pixel associated with green, and a B pixel associated with blue. The method is composed of time-divisionally driving the N×3 pixels positioned in each of the plurality of lines. A drive sequence of an $n^{th}$ line out of the plurality of lines is different from that of an $(n+1)^{th}$ line out of the plurality of lines, the $(n+1)^{th}$ line being adjacent to the $n^{th}$ line. The G pixels, each included within associated one of the first to $N^{th}$ pixels sets, are driven $(N+1)^{th}$ earliest or later for each of the $n^{th}$ and $(n+1)^{th}$ line.

9 Claims, 29 Drawing Sheets

| | BLOCK 1 | | | | | | BLOCK 2 | | | | | |
|---|---|---|---|---|---|---|---|---|---|---|---|---|
| | Pi1 | | | Pi2 | | | Pi3 | | | Pi4 | | |
| $k^{TH}$ FRAME | $R_1$ | $G_1$ | $B_1$ | $R_2$ | $G_2$ | $B_2$ | $R_3$ | $G_3$ | $B_3$ | $R_4$ | $G_4$ | $B_4$ |
| $n^{TH}$ LINE | 1 | 9 | 2 | 5 | 11 | 6 | 3 | 10 | 4 | 7 | 12 | 8 |
| $(n+1)^{TH}$ LINE | 8 | 12 | 7 | 4 | 10 | 3 | 6 | 11 | 5 | 2 | 9 | 1 |
| $(n+2)^{TH}$ LINE | 3 | 10 | 4 | 7 | 12 | 8 | 1 | 9 | 2 | 5 | 11 | 6 |
| $(n+3)^{TH}$ LINE | 6 | 11 | 5 | 2 | 9 | 1 | 8 | 12 | 7 | 4 | 10 | 3 |
| $(n+4)^{TH}$ LINE | 5 | 9 | 6 | 1 | 11 | 2 | 7 | 10 | 8 | 3 | 12 | 4 |
| $(n+5)^{TH}$ LINE | 4 | 12 | 3 | 8 | 10 | 7 | 2 | 11 | 1 | 6 | 9 | 5 |
| $(n+6)^{TH}$ LINE | 7 | 10 | 8 | 3 | 12 | 4 | 5 | 9 | 6 | 1 | 11 | 2 |
| $(n+7)^{TH}$ LINE | 2 | 11 | 1 | 6 | 9 | 5 | 4 | 12 | 3 | 8 | 10 | 7 |

⇩

| $(k+1)^{TH}$ FRAME | $R_1$ | $G_1$ | $B_1$ | $R_2$ | $G_2$ | $B_2$ | $R_3$ | $G_3$ | $B_3$ | $R_4$ | $G_4$ | $B_4$ |
|---|---|---|---|---|---|---|---|---|---|---|---|---|
| $n^{TH}$ LINE | 8 | 12 | 7 | 1 | 9 | 2 | 5 | 11 | 6 | 3 | 10 | 4 |
| $(n+1)^{TH}$ LINE | 4 | 10 | 3 | 6 | 11 | 5 | 2 | 9 | 1 | 7 | 12 | 8 |
| $(n+2)^{TH}$ LINE | 6 | 11 | 5 | 3 | 10 | 4 | 7 | 12 | 8 | 1 | 9 | 2 |
| $(n+3)^{TH}$ LINE | 2 | 9 | 1 | 8 | 12 | 7 | 4 | 10 | 3 | 5 | 11 | 6 |
| $(n+4)^{TH}$ LINE | 4 | 12 | 3 | 5 | 9 | 6 | 1 | 11 | 2 | 7 | 10 | 8 |
| $(n+5)^{TH}$ LINE | 8 | 10 | 7 | 2 | 11 | 1 | 6 | 9 | 5 | 3 | 12 | 4 |
| $(n+6)^{TH}$ LINE | 2 | 11 | 1 | 7 | 10 | 8 | 3 | 12 | 4 | 5 | 9 | 6 |
| $(n+7)^{TH}$ LINE | 6 | 9 | 5 | 4 | 12 | 3 | 8 | 10 | 7 | 1 | 11 | 2 |

| | PIXEL SET $Pi_1$ | | | PIXEL SET $Pi_2$ | | |
|---|---|---|---|---|---|---|
| | $R_1$ | $G_1$ | $B_1$ | $R_2$ | $G_2$ | $B_2$ |
| $n^{TH}$ LINE | 1 | 5 | 2 | 3 | 6 | 4 |
| $(n+1)^{TH}$ LINE | 4 | 6 | 3 | 2 | 5 | 1 |

| | PIXEL SET $Pi_1$ | | | PIXEL SET $Pi_2$ | | |
|---|---|---|---|---|---|---|
| | $R_1$ | $G_1$ | $B_1$ | $R_2$ | $G_2$ | $B_2$ |
| $n^{TH}$ LINE | 1 | 3 | 2 | 5 | 4 | 6 |
| $(n+1)^{TH}$ LINE | 6 | 4 | 5 | 2 | 3 | 1 |

| | PIXEL SET $Pi_1$ | | | PIXEL SET $Pi_2$ | | |
|---|---|---|---|---|---|---|
| | $R_1$ | $G_1$ | $B_1$ | $R_2$ | $G_2$ | $B_2$ |
| $n^{TH}$ LINE | 1 | 6 | 2 | 3 | 5 | 4 |
| $(n+1)^{TH}$ LINE | 4 | 5 | 3 | 2 | 6 | 1 |
| $(n+2)^{TH}$ LINE | 3 | 6 | 4 | 1 | 5 | 2 |
| $(n+3)^{TH}$ LINE | 2 | 5 | 1 | 4 | 6 | 3 |

| | PIXEL SET $Pi_1$ | | | PIXEL SET $Pi_2$ | | |
|---|---|---|---|---|---|---|
| | $R_1$ | $G_1$ | $B_1$ | $R_2$ | $G_2$ | $B_2$ |
| $n^{TH}$ LINE | 1 | 4 | 2 | 5 | 3 | 6 |
| $(n+1)^{TH}$ LINE | 6 | 3 | 5 | 2 | 4 | 1 |
| $(n+2)^{TH}$ LINE | 5 | 4 | 6 | 1 | 3 | 2 |
| $(n+3)^{TH}$ LINE | 2 | 3 | 1 | 6 | 4 | 5 |

Fig. 4C

PIXEL SET $Pi_1$ PIXEL SET $Pi_2$

$k^{TH}$ FRAME

| | $R_1$ | $G_1$ | $B_1$ | $R_2$ | $G_2$ | $B_2$ |
|---|---|---|---|---|---|---|
| $n^{TH}$ LINE | 1 | 6 | 2 | 3 | 5 | 4 |
| $(n+1)^{TH}$ LINE | 4 | 5 | 3 | 2 | 6 | 1 |
| $(n+2)^{TH}$ LINE | 3 | 6 | 4 | 1 | 5 | 2 |
| $(n+3)^{TH}$ LINE | 2 | 5 | 1 | 4 | 6 | 3 |

$(k+1)^{TH}$ FRAME

| | $R_1$ | $G_1$ | $B_1$ | $R_2$ | $G_2$ | $B_2$ |
|---|---|---|---|---|---|---|
| $n^{TH}$ LINE | 4 | 5 | 3 | 1 | 6 | 2 |
| $(n+1)^{TH}$ LINE | 2 | 6 | 1 | 3 | 5 | 4 |
| $(n+2)^{TH}$ LINE | 1 | 5 | 2 | 4 | 6 | 3 |
| $(n+3)^{TH}$ LINE | 3 | 6 | 4 | 2 | 5 | 1 |

$(k+2)^{TH}$ FRAME

| | $R_1$ | $G_1$ | $B_1$ | $R_2$ | $G_2$ | $B_2$ |
|---|---|---|---|---|---|---|
| $n^{TH}$ LINE | 2 | 6 | 1 | 4 | 5 | 3 |
| $(n+1)^{TH}$ LINE | 3 | 5 | 4 | 1 | 6 | 1 |
| $(n+2)^{TH}$ LINE | 4 | 6 | 3 | 2 | 5 | 2 |
| $(n+3)^{TH}$ LINE | 1 | 5 | 2 | 3 | 6 | 4 |

$(k+3)^{TH}$ FRAME

| | $R_1$ | $G_1$ | $B_1$ | $R_2$ | $G_2$ | $B_2$ |
|---|---|---|---|---|---|---|
| $n^{TH}$ LINE | 3 | 5 | 4 | 2 | 6 | 1 |
| $(n+1)^{TH}$ LINE | 1 | 6 | 2 | 4 | 5 | 3 |
| $(n+2)^{TH}$ LINE | 2 | 5 | 1 | 3 | 6 | 4 |
| $(n+3)^{TH}$ LINE | 4 | 6 | 3 | 1 | 5 | 2 |

Fig. 4D

PIXEL SET $Pi_1$ PIXEL SET $Pi_2$

$k^{TH}$ FRAME

| | $R_1$ | $G_1$ | $B_1$ | $R_2$ | $G_2$ | $B_2$ |
|---|---|---|---|---|---|---|
| $n^{TH}$ LINE | 1 | 4 | 2 | 5 | 3 | 6 |
| $(n+1)^{TH}$ LINE | 6 | 3 | 5 | 2 | 4 | 1 |
| $(n+2)^{TH}$ LINE | 5 | 4 | 6 | 1 | 3 | 2 |
| $(n+3)^{TH}$ LINE | 2 | 3 | 1 | 6 | 4 | 5 |

$(k+1)^{TH}$ FRAME

| | $R_1$ | $G_1$ | $B_1$ | $R_2$ | $G_2$ | $B_2$ |
|---|---|---|---|---|---|---|
| $n^{TH}$ LINE | 6 | 3 | 5 | 1 | 4 | 2 |
| $(n+1)^{TH}$ LINE | 2 | 4 | 1 | 5 | 3 | 6 |
| $(n+2)^{TH}$ LINE | 1 | 3 | 2 | 6 | 4 | 5 |
| $(n+3)^{TH}$ LINE | 5 | 4 | 6 | 2 | 3 | 1 |

$(k+2)^{TH}$ FRAME

| | $R_1$ | $G_1$ | $B_1$ | $R_2$ | $G_2$ | $B_2$ |
|---|---|---|---|---|---|---|
| $n^{TH}$ LINE | 2 | 4 | 1 | 6 | 3 | 5 |
| $(n+1)^{TH}$ LINE | 5 | 3 | 6 | 1 | 4 | 1 |
| $(n+2)^{TH}$ LINE | 6 | 4 | 5 | 2 | 3 | 2 |
| $(n+3)^{TH}$ LINE | 1 | 3 | 2 | 5 | 4 | 6 |

$(k+3)^{TH}$ FRAME

| | $R_1$ | $G_1$ | $B_1$ | $R_2$ | $G_2$ | $B_2$ |
|---|---|---|---|---|---|---|
| $n^{TH}$ LINE | 5 | 3 | 6 | 2 | 4 | 1 |
| $(n+1)^{TH}$ LINE | 1 | 4 | 2 | 6 | 3 | 5 |
| $(n+2)^{TH}$ LINE | 2 | 3 | 1 | 5 | 4 | 6 |
| $(n+3)^{TH}$ LINE | 6 | 4 | 5 | 1 | 3 | 2 |

Fig. 6A

| | BLOCK 1 | | | | | | BLOCK 2 | | | | | |
|---|---|---|---|---|---|---|---|---|---|---|---|---|
| | PIXEL SET Pi1 | | | PIXEL SET Pi2 | | | PIXEL SET Pi3 | | | PIXEL SET Pi4 | | |
| | $R_1$ | $G_1$ | $B_1$ | $R_2$ | $G_2$ | $B_2$ | $R_3$ | $G_3$ | $B_3$ | $R_4$ | $G_4$ | $B_4$ |
| $n^{TH}$ LINE | 1 | 2K+1 (=N+1) | 2 | 4K+1 (=2N+1) | 3K+1 | 4K+2 (=2N+2) | 3 | 2K+2 (=N+2) | 4 | 4K+3 (=2N+3) | 3K+2 | 4K+4 (=2N+4) |
| $(n+1)^{TH}$ LINE | 6K (=3N) | 4K (=2N) | 6K−1 (=3N−1) | 2K (=N) | 3K | 2K−1 (=N−1) | 6K−2 (=3N−2) | 4K (=2N−1) | 6K−3 (=3N−3) | 2K−2 (=N−2) | 3K−1 | 2K−3 (=N−3) |

| | BLOCK k | | | | | |
|---|---|---|---|---|---|---|
| | PIXEL SET Pi(2k−1) | | | PIXEL SET Pi(2k) | | |
| | $R_{2K-1}$ | $G_{2K-1}$ | $B_{2K-1}$ | $R_{2K}$ | $G_{2K}$ | $B_{2K}$ |
| ... | 2K−1 (=N−1) | 3K | 2K (=N) | 6K−1 (=3N−1) | 4K (=2N) | 6K (=3N) |
| | 4K+2 (=2N+2) | 3K+1 | 4K+1 (=2N+1) | 2 | 2K+1 (=N+1) | 1 |

Fig. 6B

| | BLOCK 1 | | BLOCK 2 | | | BLOCK k-1 | | BLOCK k | |
|---|---|---|---|---|---|---|---|---|---|
| PIXEL R | $R_1$ | $R_2$ | $R_3$ | $R_4$ | | $R_{2K-3}$ | $R_{2K-2}$ | $R_{2K-1}$ | $R_{2K}$ |
| $n^{TH}$ LINE | 1 | 2K+1 (=N+1) | 3 | 2K+3 (=N+3) | ... | 2K−3 (=N−3) | 4K−3 (=2N−3) | 2K−1 (=N−1) | 4K−1 (=2N−1) |
| $(n+1)^{TH}$ LINE | 4K (=2N) | 2K (=N) | 4K−2 (=2N−2) | 2K−2 (=N−2) | | 2K+4 (=N+4) | 4 | 2K+2 (=N+2) | 2 |
| PIXEL G | $G_1$ | $G_2$ | $G_3$ | $G_4$ | | $G_{2K-3}$ | $G_{2K-2}$ | $G_{2K-1}$ | $G_{2K}$ |
| $n^{TH}$ LINE | 4K+1 (=2N+1) | 5K+1 | 4K+2 (=2N+2) | 5K+2 | ... | 5K−1 | 6K−1 (=3N−1) | 5K | 6K (=3N) |
| $(n+1)^{TH}$ LINE | 6K (=3N) | 5K | 6K−1 (=3N−1) | 5K−1 | | 5K+2 | 4K+2 (=2N+2) | 5K+1 | 4K+1 (=2N+1) |
| PIXEL B | $B_1$ | $B_2$ | $B_3$ | $B_4$ | | $B_{2K-3}$ | $B_{2K-2}$ | $B_{2K-1}$ | $B_{2K}$ |
| $n^{TH}$ LINE | 2 | 2K+2 (=N+2) | 4 | 2K+4 (=N+4) | ... | 2K−2 (=N−2) | 4K−2 (=2N−2) | 2K (=N) | 4K (=2N) |
| $(n+1)^{TH}$ LINE | 4K−1 (=2N−1) | 2K−1 (=N−1) | 4K−3 (=2N−3) | 2K−3 (=N−3) | | 2K+3 (=N+3) | 3 | 2K+1 (=N+1) | 1 |

Fig. 7A

| | BLOCK 1 | | | | | | BLOCK 2 | | | | | |
|---|---|---|---|---|---|---|---|---|---|---|---|---|
| | PIXEL SET Pi1 | | | PIXEL SETPi2 | | | PIXEL SET Pi3 | | | PIXEL SET Pi4 | | |
| | $R_1$ | $G_1$ | $B_1$ | $R_2$ | $G_2$ | $B_2$ | $R_3$ | $G_3$ | $B_3$ | $R_4$ | $G_4$ | $B_4$ |
| $n^{TH}$ LINE | 1 | 4K+1 (=2N+1) | 2 | 2K+1 (=N+1) | 5K+1 | 2K+2 (=N+2) | 3 | 4K+2 (=2N+2) | 4 | 2K+3 (=N+3) | 5K+2 | 2K+4 (=N+4) |
| $(n+1)^{TH}$ LINE | 4K (=2N) | 6K (=3N) | 4K−1 (=2N−1) | 2K (=N) | 5K | 2K−1 (=N−1) | 4K−2 (=2N−2) | 6K (=3N−1) | 4K−3 (=2N−3) | 2K−2 (=N−2) | 5K−1 | 2K−3 (=N−3) |

| | BLOCK K | | | | | |
|---|---|---|---|---|---|---|
| | PIXEL SET Pi(2K−1) | | | PIXEL SET Pi(2K) | | |
| | $R_{2K-1}$ | $G_{2K-1}$ | $B_{2K-1}$ | $R_{2K}$ | $G_{2K}$ | $B_{2K}$ |
| ... | 2K−1 (=N−1) | 5K | 2K (=N) | 4K−1 (=2N−1) | 6K (=3N) | 4K (=2N) |
| | 2K+2 (=N+2) | 5K+1 | 2K+1 (=N+1) | 2 | 4K+1 (=2N+1) | 1 |

Fig. 7B

| | BLOCK 1 | | BLOCK 2 | | | BLOCK k-1 | | BLOCK k | |
|---|---|---|---|---|---|---|---|---|---|
| PIXEL R | $R_1$ | $R_2$ | $R_3$ | $R_4$ | | $R_{2K-3}$ | $R_{2K-2}$ | $R_{2K-1}$ | $R_{2K}$ |
| $n^{TH}$ LINE | 1 | 4K+1 (=2N+1) | 3 | 4K+3 (=2N+3) | ... | 2K-3 (=N-3) | 6K-3 (=3N-3) | 2K-1 (=N-1) | 6K-1 (=3N-1) |
| $(n+1)^{TH}$ LINE | 6K (=3N) | 2K (=N) | 6K-2 (=3N-2) | 2K-2 (=N-2) | | 4K+4 (=2N+4) | 4 | 4K+2 (=2N+2) | 2 |
| PIXEL G | $G_1$ | $G_2$ | $G_3$ | $G_4$ | | $G_{2K-3}$ | $G_{2K-2}$ | $G_{2K-1}$ | $G_{2K}$ |
| $n^{TH}$ LINE | 2K+1 (=N+1) | 3K+1 | 2K+2 (=N+2) | 3K+2 | ... | 3K-1 | 4K-1 (=2N-1) | 3K | 4K (=2N) |
| $(n+1)^{TH}$ LINE | 4K (=2N) | 3K | 4K-1 (=2N-1) | 3K-1 | | 3K+2 | 2K+2 (=N+2) | 3K+1 | 2K+1 (=N+1) |
| PIXEL B | $B_1$ | $B_2$ | $B_3$ | $B_4$ | | $B_{2K-3}$ | $B_{2K-2}$ | $B_{2K-1}$ | $B_{2K}$ |
| $n^{TH}$ LINE | 2 | 4K+2 (=2N+2) | 4 | 4K+4 (=2N+4) | ... | 2K-2 (=N-2) | 6K-2 (=3N-2) | 2K (=N) | 6K (=3N) |
| $(n+1)^{TH}$ LINE | 6K-1 (=3N-1) | 2K-1 (=N-1) | 6K-3 (=3N-3) | 2K-3 (=N-3) | | 4K+3 (=2N+3) | 3 | 4K+1 (=2N+1) | 1 |

$S^{ALL}$ = {1, 2, ···, 3N}

Fig. 9A

PIXEL SETPi1 BLOCK 1 PIXEL SETPi2 PIXEL SETPi3 BLOCK 2 PIXEL SETPi4

| | $R_1$ | $G_1$ | $B_1$ | $R_2$ | $G_2$ | $B_2$ | $R_3$ | $G_3$ | $B_3$ | $R_4$ | $G_4$ | $B_4$ |
|---|---|---|---|---|---|---|---|---|---|---|---|---|
| $n^{TH}$ LINE | 1 | 4K+1 (=2N+1) | 2 | 2K+1 (=N+1) | 5K+1 | 2K+2 (=N+2) | 3 | 4K+2 (=2N+2) | 4 | 2K+3 (=N+3) | 5K+2 | 2K+4 (=N+4) |
| $(n+1)^{TH}$ LINE | 4K (=2N) | 6K (=3N) | 4K−1 (=2N−1) | 2K (=N) | 5K | 2K−1 (=N−1) | 4K−2 (=2N−2) | 6K (=3N−1) | 4K−3 (=2N−3) | 2K−2 (=N−2) | 5K−1 | 2K−3 (=N−3) |
| $(n+2)^{TH}$ LINE | BLOCK 2 | | | | | | BLOCK 3 | | | | | |
| $(n+3)^{TH}$ LINE | | | | | | | | | | | | |
| $(n+4)^{TH}$ LINE | BLOCK 3 | | | | | | BLOCK 4 | | | | | |
| $(n+5)^{TH}$ LINE | | | | | | | | | | | | |
| $(n+N+1)^{TH}$ LINE | BLOCK K | | | | | | BLOCK 1 | | | | | |
| $(n+N)^{TH}$ LINE | 2K+1 (=N+1) | 4K+1 (=2N+1) | 2K+2 (=N+2) | 1 | 5K+1 | 2 | 2K+3 (=N+3) | 4K+2 (=2N+2) | 2K+4 (=N+4) | 3 | 5K+2 | 4 |
| $(n+N+1)^{TH}$ LINE | 2K (=N) | 6K (=3N) | 2K−1 (=N−1) | 4K (=2N) | 5K | 4K−1 (=2N−1) | 2K−2 (=N−2) | 6K (=3N−1) | 2K−3 (=N−3) | 4K−2 (=2N−2) | 5K−1 | 4K−3 (=2N−3) |
| $(n+N+2)^{TH}$ LINE | BLOCK 2' | | | | | | BLOCK 3' | | | | | |
| $(n+N+3)^{TH}$ LINE | | | | | | | | | | | | |
| $(n+N+4)^{TH}$ LINE | BLOCK 3' | | | | | | BLOCK 4' | | | | | |
| $(n+N+5)^{TH}$ LINE | | | | | | | | | | | | |
| $(n+2N-2)^{TH}$ LINE | BLOCK k' | | | | | | BLOCK 1' | | | | | |
| $(n+2N-1)^{TH}$ LINE | | | | | | | | | | | | |

BLOCK 1' BLOCK 2'

Fig. 9C

| | $Pi_1$ | | | $Pi_2$ | | | $Pi_3$ | | | $Pi_4$ | | |
|---|---|---|---|---|---|---|---|---|---|---|---|---|
| | $R_1$ | $G_1$ | $B_1$ | $R_2$ | $G_2$ | $B_2$ | $R_3$ | $G_3$ | $B_3$ | $R_4$ | $G_4$ | $B_2$ |
| $n^{TH}$ LINE | 1 | 9 | 2 | 5 | 11 | 6 | 3 | 10 | 4 | 7 | 12 | 8 |
| $(n+1)^{TH}$ LINE | 8 | 12 | 7 | 4 | 10 | 3 | 6 | 11 | 5 | 2 | 9 | 1 |
| $(n+2)^{TH}$ LINE | 3 | 10 | 4 | 7 | 12 | 8 | 1 | 9 | 2 | 5 | 11 | 6 |
| $(n+3)^{TH}$ LINE | 6 | 11 | 5 | 2 | 9 | 1 | 8 | 12 | 7 | 4 | 10 | 3 |
| $(n+4)^{TH}$ LINE | 5 | 9 | 6 | 1 | 11 | 2 | 7 | 10 | 8 | 3 | 12 | 4 |
| $(n+5)^{TH}$ LINE | 4 | 12 | 3 | 8 | 10 | 7 | 2 | 11 | 1 | 6 | 9 | 5 |
| $(n+6)^{TH}$ LINE | 7 | 10 | 8 | 3 | 12 | 4 | 5 | 9 | 6 | 1 | 11 | 2 |
| $(n+7)^{TH}$ LINE | 2 | 11 | 1 | 6 | 9 | 5 | 4 | 12 | 3 | 8 | 10 | 7 |

BLOCK 1

BLOCK 2

BLOCK 2'

BLOCK 1'

Fig. 11

BLOCK 1 | BLOCK 2

$Pi_1$ | $Pi_2$ | $Pi_3$ | $Pi_4$ $k^{TH}$ FRAME

| | $R_1$ | $G_1$ | $B_1$ | $R_2$ | $G_2$ | $B_2$ | $R_3$ | $G_3$ | $B_3$ | $R_4$ | $G_4$ | $B_4$ |
|---|---|---|---|---|---|---|---|---|---|---|---|---|
| $n^{TH}$ LINE | 1 | 9 | 2 | 5 | 11 | 6 | 3 | 10 | 4 | 7 | 12 | 8 |
| $(n+1)^{TH}$ LINE | 8 | 12 | 7 | 4 | 10 | 3 | 6 | 11 | 5 | 2 | 9 | 1 |

$(k+1)^{TH}$ FRAME

| | $R_1$ | $G_1$ | $B_1$ | $R_2$ | $G_2$ | $B_2$ | $G_3$ | $B_3$ | $R_3$ | $G_4$ | $B_4$ | $B_4$ |
|---|---|---|---|---|---|---|---|---|---|---|---|---|
| $n^{TH}$ LINE | 8 | 12 | 7 | 1 | 9 | 2 | 5 | 11 | 6 | 3 | 10 | 4 |
| $(n+1)^{TH}$ LINE | 4 | 10 | 3 | 6 | 11 | 5 | 2 | 9 | 1 | 7 | 12 | 8 |

$(k+2)^{TH}$ FRAME

| | $R_1$ | $G_1$ | $B_1$ | $R_2$ | $G_2$ | $B_2$ | $G_3$ | $B_3$ | $R_3$ | $G_4$ | $B_4$ | $B_4$ |
|---|---|---|---|---|---|---|---|---|---|---|---|---|
| $n^{TH}$ LINE | 4 | 10 | 3 | 8 | 12 | 7 | 1 | 9 | 2 | 5 | 11 | 6 |
| $(n+1)^{TH}$ LINE | 11 | 5 | 5 | 2 | 9 | 1 | 7 | 12 | 8 | 3 | 10 | 4 |

$(k+3)^{TH}$ FRAME

| | $R_1$ | $G_1$ | $B_1$ | $R_2$ | $G_2$ | $B_2$ | $G_3$ | $B_3$ | $R_3$ | $G_4$ | $B_4$ | $B_4$ |
|---|---|---|---|---|---|---|---|---|---|---|---|---|
| $n^{TH}$ LINE | 5 | 11 | 6 | 3 | 10 | 4 | 7 | 12 | 8 | 2 | 9 | 1 |
| $(n+1)^{TH}$ LINE | 1 | 9 | 2 | 8 | 12 | 7 | 4 | 10 | 3 | 6 | 11 | 5 |

Fig. 12

| | BLOCK 1 | | | | | | BLOCK 2 | | | | | |
|---|---|---|---|---|---|---|---|---|---|---|---|---|
| | Pi1 | | | Pi2 | | | Pi3 | | | Pi4 | | |
| $k^{TH}$ FRAME | $R_1$ | $G_1$ | $B_1$ | $R_2$ | $G_2$ | $B_2$ | $R_3$ | $G_3$ | $B_3$ | $R_4$ | $G_4$ | $B_4$ |
| $n^{TH}$ LINE | 1 | 9 | 2 | 5 | 11 | 6 | 3 | 10 | 4 | 7 | 12 | 8 |
| $(n+1)^{TH}$ LINE | 8 | 12 | 7 | 4 | 10 | 3 | 6 | 11 | 5 | 2 | 9 | 1 |
| $(n+2)^{TH}$ LINE | 3 | 10 | 4 | 7 | 12 | 8 | 1 | 9 | 2 | 5 | 11 | 6 |
| $(n+3)^{TH}$ LINE | 6 | 11 | 5 | 2 | 9 | 1 | 8 | 12 | 7 | 4 | 10 | 3 |
| $(n+4)^{TH}$ LINE | 5 | 9 | 6 | 1 | 11 | 2 | 7 | 10 | 8 | 3 | 12 | 4 |
| $(n+5)^{TH}$ LINE | 4 | 12 | 3 | 8 | 10 | 7 | 2 | 11 | 1 | 6 | 9 | 5 |
| $(n+6)^{TH}$ LINE | 7 | 10 | 8 | 3 | 12 | 4 | 5 | 9 | 6 | 1 | 11 | 2 |
| $(n+7)^{TH}$ LINE | 2 | 11 | 1 | 6 | 9 | 5 | 4 | 12 | 3 | 8 | 10 | 7 |

⇩

| $(k+1)^{TH}$ FRAME | $R_1$ | $G_1$ | $B_1$ | $R_2$ | $G_2$ | $B_2$ | $R_3$ | $G_3$ | $B_3$ | $R_4$ | $G_4$ | $B_4$ |
|---|---|---|---|---|---|---|---|---|---|---|---|---|
| $n^{TH}$ LINE | 8 | 12 | 7 | 1 | 9 | 2 | 5 | 11 | 6 | 3 | 10 | 4 |
| $(n+1)^{TH}$ LINE | 4 | 10 | 3 | 6 | 11 | 5 | 2 | 9 | 1 | 7 | 12 | 8 |
| $(n+2)^{TH}$ LINE | 6 | 11 | 5 | 3 | 10 | 4 | 7 | 12 | 8 | 1 | 9 | 2 |
| $(n+3)^{TH}$ LINE | 2 | 9 | 1 | 8 | 12 | 7 | 4 | 10 | 3 | 5 | 11 | 6 |
| $(n+4)^{TH}$ LINE | 4 | 12 | 3 | 5 | 9 | 6 | 1 | 11 | 2 | 7 | 10 | 8 |
| $(n+5)^{TH}$ LINE | 8 | 10 | 7 | 2 | 11 | 1 | 6 | 9 | 5 | 3 | 12 | 4 |
| $(n+6)^{TH}$ LINE | 2 | 11 | 1 | 7 | 10 | 8 | 3 | 12 | 4 | 5 | 9 | 6 |
| $(n+7)^{TH}$ LINE | 6 | 9 | 5 | 4 | 12 | 3 | 8 | 10 | 7 | 1 | 11 | 2 |

Fig. 14

| | PIXEL SET $Pi_1$ | | | PIXEL SET $Pi_2$ | | |
|---|---|---|---|---|---|---|
| | $R_1$ | $G_1$ | $B_1$ | $R_2$ | $G_2$ | $B_2$ |
| $n^{TH}$ LINE | 1 | 3 | 2 | 2 | 3 | 1 |
| $(n+1)^{TH}$ LINE | 2 | 3 | 1 | 1 | 3 | 2 |

METHOD AND DRIVE SEQUENCE FOR TIME-DIVISIONALLY DRIVING A DISPLAY PANEL

BACKGROUND OF THE INVENTION

1. Field of the Invention

The present invention relates to display panel driving methods, display panel drivers, and display panel driving programs. Particularly, the present invention relates to driving techniques for time-divisionally driving two or more signal lines (data lines) within a display panel with a single amplifier.

2. Description of the Related Art

As display panels have been shifted to higher resolution, signal lines (or data lines) within display panels are significantly increased in the number, and thus the intervals between adjacent signal lines are significantly decreased. One issue caused by the increase in the number of the signal lines is difficulty in providing electrical connections between the signal lines and the display panel driver; the decrease in the intervals between adjacent signal lines undesirably makes it difficult to provide sufficient spacing between external wirings connected between the signal lines and the display panel driver. Another issue is the increase in the number of amplifiers for driving the signal lines incorporated within the driver. The increased number of amplifiers undesirably increases the size of the driver, and thus increases the cost.

One approach for overcoming the above described issues is a time-divisional drive technique, which involves driving two or more signal lines within a display panel with a single amplifier in a time divisional manner. Japanese Laid-Open Patent Application No. H04-52684A, for example, discloses one of such techniques where three signal lines are selectively conducted by the action of three switching elements mounted on a liquid crystal display panel for operation in a time division mode.

FIG. 1 is a block diagram of a display device employing the technique disclosed in this document. The display device is designed to drive three signal lines with a single amplifier in a time-divisional manner.

Specifically, the display device is composed of a liquid crystal panel 10 and a driver 20. The liquid crystal panel 10 includes a set of signal lines $D_R$, $D_G$, and $D_B$, associated with red (R), green (G), and blue (B), respectively, and a set of scanning (gate) lines $G_1$, $G_2$, . . . $G_M$ (M being a natural number equal to or more than two). The signal lines $D_R$, $D_G$, and $D_B$ may be collectively referred to as signal lines D, hereinafter, when they need not to be discriminated. There is provided an R pixel $C_i^R$ at the intersection of the signal line $D_R$ and the scanning (gate) line $G_i$. Correspondingly, provided are a G pixel $C_i^G$ associated with green at the intersection of the signal line $D_G$ and the scanning (gate) line $G_i$, and a B pixel $C_i^B$ at the intersection of the signal line $D_B$ and the scanning (gate) line $G_i$. The R pixel $C_i^R$, the G pixel $C_i^G$, and the B pixel $C_i^B$, which are aligned in the horizontal along the scanning line $G_i$, construct a pixel set $P_i$, which functions as a dot representing color within the liquid crystal panel 10.

Each pixel includes a TFT (thin film transistor) 11 and a liquid crystal capacitor 12. The liquid crystal capacitor 12 is composed of a pixel electrode 12*a* and a common electrode 12*b*, filled with liquid crystal material therebetween. The sources of the TFTs 11 within the R pixel $C_i^R$, the G pixel $C_i^G$, and the B pixel $C_i^B$ are connected to the associated signal lines $D_R$, $D_G$, and $D_B$, and the gates of the TFTs 11 are commonly connected to the scanning line $G_j$. The drains of the TFTs 11 are connected to the pixel electrodes 12*a* of the liquid crystal capacitors 12.

The signal lines $D_R$, $D_G$, and $D_B$ are connected to input terminals 14 via switches $\mathbf{13}_R$, $\mathbf{13}_G$, and $\mathbf{13}_B$, respectively. The switches $\mathbf{13}_R$, $\mathbf{13}_G$, and $\mathbf{13}_B$ are composed of TFTs integrated within the liquid crystal panel 10. The switches $\mathbf{13}_R$, $\mathbf{13}_G$, and $\mathbf{13}_B$ are turned on and off in response to control signals $S_1$, $S_2$, and $S_3$ received from the driver 20, respectively. The input terminals 14 receive drive voltages from the driver 20 for driving the associated pixels. As described later in more detail, the drive voltages used for driving the R pixel $C_i^R$, the G pixel $C_i^G$, and the B pixel $C_i^B$ are sequentially supplied to the input terminals 14; with the switches $\mathbf{13}_R$, $\mathbf{13}_G$, and $\mathbf{13}_B$ turned on and off exclusively, the drive voltages are serially supplied in a sequence to the signal lines $D_R$, $D_G$, and $D_B$ for selectively driving the R pixel $C_i^R$, the G pixel $C_i^G$, and the B pixel $C_i^B$. The switches $\mathbf{13}_R$, $\mathbf{13}_G$, and $\mathbf{13}_B$ may be collectively referred to as switches 13, hereinafter, for ease of the description.

The driver 20 includes a shift register 21, a data register 22, a latch circuit 23, a D/A converter 24, and a set of amplifiers 25. The shift register 21 shifts an input clock signal CLK therein for generating shifted pulses. The data register 22 is triggered with the shifted pulses to latch the data signal and for providing a series of RGB data indicative of the graylevel of each pixel. The latch circuit 23 latches the RGB data received from the data register 22, and provides the D/A converter 24 with the latched RGB data. In response to the RGB data received from the latch circuit 23, the D/A converter 24 selects and supplies a set of desired grayscale voltages to the amplifiers 25. The grayscale voltages received from the D/A converter 24 are then amplified and transferred by the amplifiers 25 to the input terminals 14 of the liquid crystal panel 10.

The driver 20 additionally includes a control circuit 26 for generating the control signals $S_1$, $S_2$, and $S_3$. The control signals $S_1$, $S_2$, and $S_3$ are forwarded to the respective switches 13 to select the switches 13. The control circuit 26 provides a timing control for synchronizing the control signals $S_1$, $S_2$, and $S_3$ with the timing of supplying the drive voltages from the amplifiers 25 to the input terminals 14. The timing control by the control circuit 26 allows the switches 13 to be turned on and off as timed with the drive voltages being received by the input terminals 14 and delivered to the desired signal lines. The timing control of the control circuit 26 is conducted in accordance with a program stored in a storage device of the driver 20 (not shown).

Driving a set of the R pixel $C_n^R$, the G pixel $C_n^G$, and the B pixel $C_n^B$ along an $n^{th}$ line is achieved through the following sequence.

At first, the $n^{th}$ scanning line $G_n$, connected to the R pixel $C_n^R$, the G pixel $C_n^G$, and the B pixel $C_n^B$, is activated to turn on the TFTs 11 within the R pixel $C_n^R$, the G pixel $C_n^G$, and the B pixel $C_n^B$. This allows the R pixel $C_n^R$, the G pixel $C_n^G$, and the B pixel $C_n^B$ to be ready to receive the drive voltages.

The drive voltage to be supplied to the R pixel $C_n^R$ is then provided from the associated amplifier 25 to the associated input terminal 14. In synchronization of the provision of the drive voltage, the signal line $D_R$ is selected; more specifically, the switch $\mathbf{13}_R$ is turned on with the other switches $\mathbf{13}_G$ and $\mathbf{13}_B$ turned off. As a result, the signal line $D_R$ is connected to the input terminal 14 while the other signal lines $D_G$ and $D_B$ are placed into the high-impedance state, disconnected from the input terminal 14. This allows the drive voltage to be transferred along the signal line $D_R$ to the R pixel $C_n^R$. This achieves charging the liquid crystal capacitor 12 within the R pixel $C_n^R$ with the drive voltage.

Then, the drive voltage to be supplied to the G pixel $C_n^G$ is provided from the amplifier 25 to the input terminal 14. In synchronization with the provision of the drive voltage, the signal line $D_G$ is selected. This allows the drive voltage to be transferred along the signal line $D_G$ and received by the G pixel $C_n^G$.

Correspondingly, the drive voltage to be supplied to the B pixel $C_n^B$ is provided from the amplifier 25 to the input terminal 14. In synchronization with the provision of the drive voltage, the signal line $D_B$ is selected. This allows the drive voltage to be transferred along the signal line $D_B$ and received by the B pixel $C_n^B$.

As described above, the signal lines $D_R$, $D_G$, and $D_B$ are time-divisionally driven by the amplifier 25, and the drive voltages are written into the R pixel $C_n^R$, the G pixel $C_n^G$, and the B pixel $C_n^B$ in this order.

The aforementioned Japanese Laid-Open Patent application discloses that signal lines may not be associated with R, G, and B colors, and that the number of signal lines driven with a single amplifier may be two or four or more. Japanese Laid-Open Patent Application No. P2001-109435A, for example, discloses a technique for switching two signal lines with a selector circuit within a display panel. Additionally, Japanese Laid-Open Patent Application No. P2001-337657A discloses a technique for switching six signal lines with six analog switches.

The two known techniques, however, have a drawback that the drive voltage developed across the liquid crystal capacitor 12 within each pixel may be varied from the desired level after the associated signal line is placed into the high-impedance state, disconnected from the associated input terminal 14.

The variation in the drive voltage may result from three major causes. The first cause is leakage through TFTs within the switches 13 provided for switching the signal lines D. Referring to FIG. 1, the signal lines D are inevitably long, and thus have increased capacitance. This requires the TFTs within the switches 13 to have increased drive ability for driving the signal lines D. Accordingly, the TFTs are designed to have an increased gate width and reduced gate length, and a small on-resistance; however, such designed TFTs suffer from increased leakage. Therefore, charges accumulated at the pixel electrodes 12*a* are discharged through the TFTs within the switches 13 hence declining the drive voltages from the desired levels. Such leakage is enhanced as the difference between the drive voltages to be supplied to the adjacent signal lines is increased.

The second cause is capacitance coupling between the signal lines. When the signal line $D_G$ is driven with a drive voltage after the adjacent signal line $D_R$ is placed into the high-impedance state, for example, the voltage on the signal line $D_R$ is varied by the effect of capacitance coupling between the two signal lines $D_R$ and $D_G$. Such variation in the voltage at the signal line $D_R$ will result in a change in the drive voltage across the pixel.

The third cause is delay of the rise (or the fall) of a common voltage $V_{COM}$ developed on the common electrode 12*b*. In AC driving, the common voltage $V_{COM}$ is inverted before the drive voltage is fed to the pixel. During the pixels being driven with the associated drive voltages, the common voltage $V_{COM}$ should remain stable. As the common electrode 12*b* has a large size, the duration required for driving the common electrode 12*b* is inevitably prolonged. As a result, the common voltage $V_{COM}$ may be varied during the drive of the pixels. Such variation thus causes a change in the drive voltages from the desired levels. Pixels driven at the earlier stage experience increased change in the drive voltages.

The changes in the drive voltages will be perceived as uneven brightness by the user of the liquid crystal penal 10. More particularly, the changes in the drive voltages appear as vertical segments of uneven brightness (along the signal lines D1 to D3).

The increase in the number of the signal lines for each amplifier undesirably causes increased change in the drive voltages. The changes in the drive voltages is thus emphasized as one of the most critical drawbacks of recent liquid crystal panels that are designed to time-divisionally drive six or more signals lines.

Additionally, Japanese Laid-Open Patent Application No. P2001-109435A discloses a display device which drives two signal lines with a single amplifier, in which the write sequences of the pixels are switched for every vertical and/or horizontal scanning period. This technique allows the pixels experiencing increased changes in the drive voltages to be temporally and/or spatially scattered, thus eliminating vertical segments of uneven brightness.

SUMMARY OF THE INVENTION

In an aspect of the present invention, a method is provided for driving a display panel including N×3 pixels arranged along each of a plurality of lines extending in a scanning line direction with N being an integer equal to or more than 2, the N×3 pixels constituting first to $N^{th}$ pixel sets each comprising an R pixel associated with red, a G pixel associated with green, and a B pixel associated with blue. The method is composed of time-divisionally driving the N×3 pixels positioned in each of the plurality of lines. A drive sequence of an $n^{th}$ line out of the plurality of lines is different from that of an $(n+1)^{th}$ line out of the plurality of lines, the $(n+1)^{th}$ line being adjacent to the $n^{th}$ line. The G pixels, each included within associated one of the first to $N^{th}$ pixels sets, are driven $(N+1)^{th}$ earliest or later for each of the $n^{th}$ and $(n+1)^{th}$ line.

The fact that the drive sequence of an $n^{th}$ line out of the plurality of lines is different from that of an $(n+1)^{th}$ line out of the plurality of lines is effective for spatially distributing pixels experiencing increased changes of drive voltages thereacross. Additionally, the fact that the G pixels, each included within associated one of the first to $N^{th}$ pixels sets, are driven $(N+1)^{th}$ earliest or later for each of the $n^{th}$ and $(n+1)^{th}$ line is effective for reducing uneven brightness due to the effects of the spectrum luminous efficacy characteristics of human vision.

BRIEF DESCRIPTION OF THE DRAWINGS

The above and other advantages and features of the present invention will be more apparent from the following description taken in conjunction with the accompanied drawings, in which:

FIG. 4C illustrates still another exemplary drive sequence of each line for each frame, based on a frame rate control technique in the first embodiment;

FIG. 4D illustrates yet still another exemplary drive sequence of each line for each frame, based on a frame rate control technique in the first embodiment;

FIG. 6A illustrates an example of the drive sequence of each line in a second embodiment of the present invention for the case when the line cycle is two lines and the ordinal numbers of G pixels are equal to or more than 2N+1;

FIG. 6B includes a set of tables separately illustrating ordinal numbers of R, G, and B pixels for the drive sequences shown in FIG. 6A;

FIG. 7A illustrates an example of the drive sequence of each line in the second embodiment for the case when the line cycle is two lines and the ordinal numbers of G pixels is in the range of N+1 to 2N;

FIG. 7B includes a set of tables separately illustrating ordinal numbers of R, G, and B pixels for the drive sequences shown in FIG. 7A;

FIGS. 9A and 9B illustrate an example of the drive sequence of each line in the second embodiment for the case when the line cycle is 2N lines;

FIG. 9C illustrates an example of the drive sequence of each line for N being four (that is, for K being two);

FIG. 11 illustrates an example of the drive sequence of each line for each frame in the second embodiment for the case when the line cycle is two lines and a frame rate control technique is employed;

FIG. 12 illustrates an example of the drive sequence of each line each line in the second embodiment for the case when the line cycle is eight lines with K being two and a frame rate control technique is employed;

FIG. 14 illustrates an example of the drive sequence of each line in the third embodiment;

DESCRIPTION OF THE PREFERRED EMBODIMENTS

The invention will be now described herein with reference to illustrative embodiments. Those skilled in the art would recognize that many alternative embodiments can be accomplished using the teachings of the present invention and that the invention is not limited to the embodiments illustrated for explanatory purposed.

First Embodiment

1. Structure of Display Device

Figure 1:
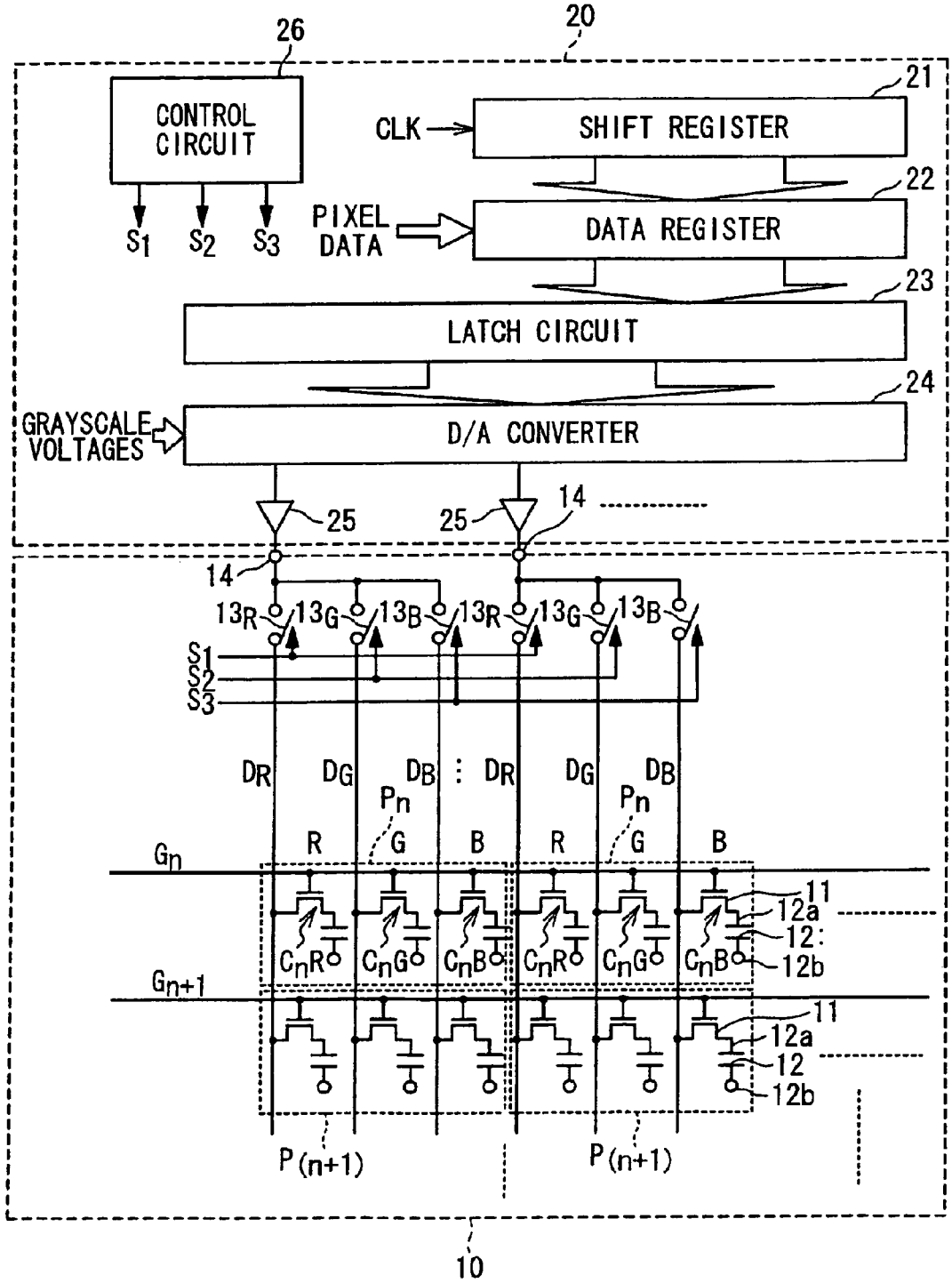
Fig. 1 Prior Art
FIG. 1 is a block diagram showing an arrangement of a display device in which a conventional display panel driving method is implemented.
Figure 2:
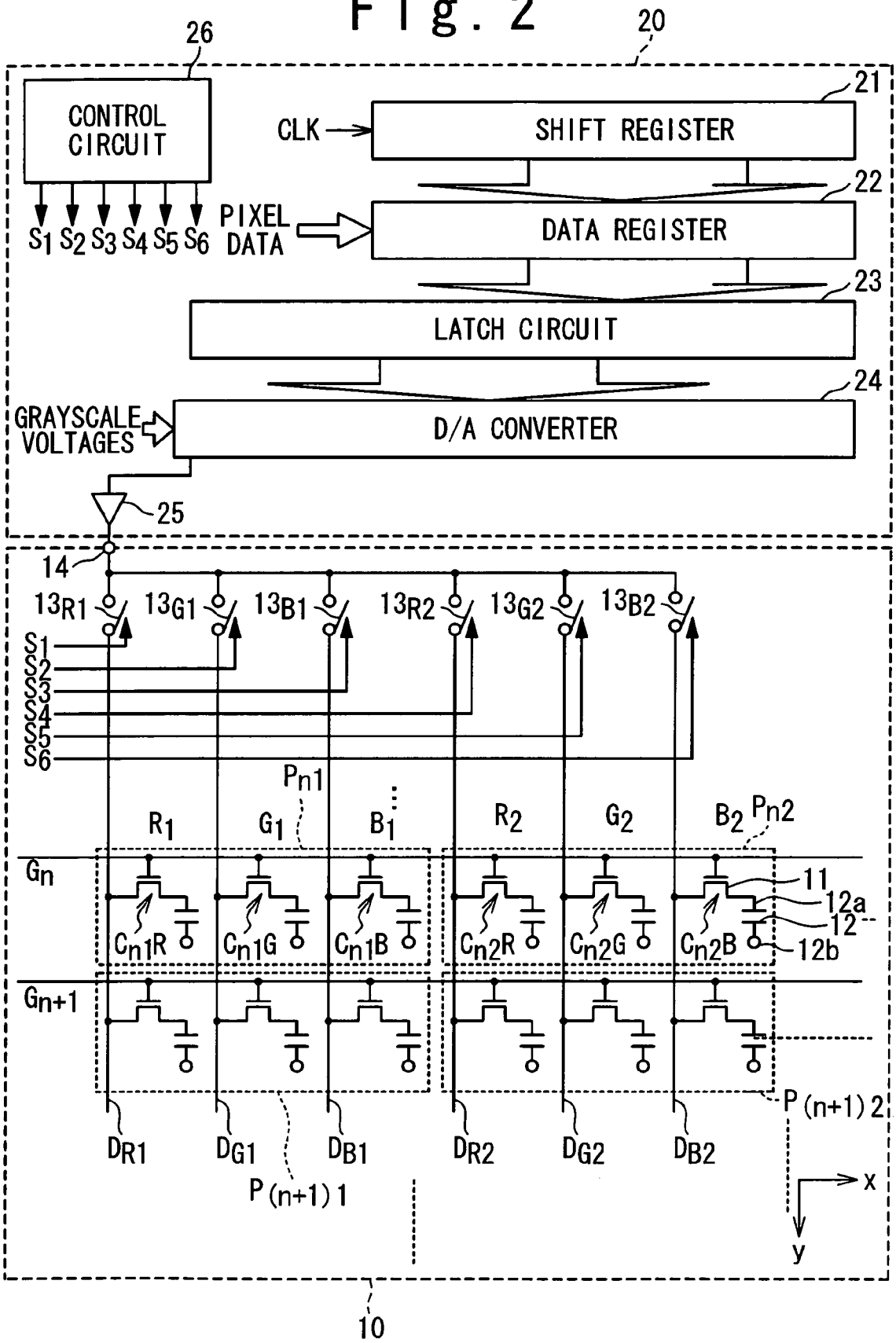
FIG. 2 is a block diagram showing an arrangement of a display device in which a display panel driving method of a first embodiment of the present invention is implemented.

In a first embodiment, as shown in FIG. 2, a display panel driving method according to the present invention is employed in a display device designed to drive six signal lines in a time-divisional manner. The display device according to the first embodiment is almost similar in the arrangement to the display device shown in FIG. 1, except that the number of signal lines to be driven by a single amplifier is different. Like components shown in FIG. 2 are denoted by like numerals as those shown in FIG. 1. The display device in the first embodiment will schematically be described.

In this embodiment, the display device is composed of a liquid crystal panel 10 incorporating an array of pixels, and a driver 20 for driving the liquid crystal panel 10. The liquid crystal panel 10 includes a set of scanning lines $G_1$, $G_2$. . . , signal lines $D_{R1}$ and $D_{R2}$ associated with red, signal lines $D_{G1}$ and $D_{G2}$ associated with green, and signal lines $D_{B1}$ and $D_{B2}$ associated with blue. The signal lines $D_{R1}$, $D_{G1}$, $D_{B1}$, $D_{R2}$, $D_{G2}$, and $D_{B2}$ are connected to input terminals 14 through switches $\mathbf{13}_{R1}$, $\mathbf{13}_{G1}$, $\mathbf{13}_{B1}$, $\mathbf{13}_{R2}$, $\mathbf{13}_{G2}$, and $\mathbf{13}_{B2}$ respectively.

There is provided pixels at respective intersections of the scanning lines and the signal lines. More particularly, an R pixel $C_{i1}^{R}$ is provided at the intersection between the signal line $D_{R1}$ and the scanning line $G_i$ while another R pixel $C_{i2}^{R}$ is provided at the intersection between the signal line $DR_{R2}$ and the scanning line $G_i$ for representing red. Similarly, G pixels $C_{i1}^{G}$ and $C_{i2}^{G}$ are provided at the intersections of the scanning line $G_i$ and the signal lines $D_{G1}$, and $D_{G2}$, respectively, for representing green. Finally, B pixels $C_{i1}^{B}$ and $C_{i2}^{B}$ are provided at the intersections between the scanning line $G_i$ and the signal lines $D_{B1}$ and $D_{B2}$, respectively, for representing blue.

Six pixels aligned along the same scanning line and connected to the same input terminal 14 are grouped to two pixel sets, each consisting of R, G, and B, pixels. For example, the R pixel $C_{n1}^{R}$, the G pixel $C_{n1}^{G}$, and the B pixel $C_{n1}^{B}$, aligned along the $n^{th}$ scanning line, are grouped into a pixel set $P_{n1}$. Correspondingly, the R pixel $C_{n2}^{R}$, the G pixel $C_{n2}^{G}$, and the B pixel $C_{n2}^{B}$ are grouped into another pixel set $P_{n2}$. The three primary color pixels within a pixel set reproduce a desired color at the dot within the liquid crystal panel 10.

In the description hereinafter, additional subscripts are attached to the letters "R", "G", and "B", which representing red, green, and blue, for identifying different pixels associated with the same color. For example, the three primary color pixels in the pixel set $P_{i1}$ are expressed as the $R_1$ pixel, the $G_1$ pixel, and the $B_1$ pixel. Similarly, the three primary color pixels in the pixel unit $P_{i2}$ are expressed as the $R_2$ pixel, the $G_2$ pixel, and the $B_2$ pixel. It is also noted that the subscripts attached to the symbols "R", "G", and "B" are indicative of columns of the pixels (that is, the signal lines connected to the pixels). For example, the $R_1$ pixels, connected to the signal line $D_{R1}$, are arranged in a different column from the $R_2$ pixels, connected to the signal line $D_{R2}$.

The driver 20 of FIG. 2 is substantially equal in the arrangement to that of FIG. 1. The driver 20 includes a shift register 21, a data register 22, a latch circuit 23, a D/A converter 24, a set of amplifiers 25, and a control circuit 26. The driver 20 serially provides drive voltages for the input terminals 14 of the liquid crystal panel 10 from the amplifiers 25, and also provides the switches 13 within the liquid crystal panel 10 with control signals $S_1$ to $S_6$. The control circuit 26 provides timing control for achieving synchronization between the timing of the input terminals 14 receiving the drive voltages and the timing of the control signals $S_1$ to $S_6$ being activated (i.e. the switches 13 being turned on). This allows desired ones of the signal lines to be selected for providing the desired pixels with the associated drive voltages. The timing control of the control circuit 26 is performed in accordance with a program stored in a storage device (not shown) of the driver 20.

2. Principle of Display Panel Drive

The display panel drive scheme of this embodiment addresses reducing the unevenness in the brightness through appropriately determining the sequence of driving six pixels that are aligned in the same scanning line and connected to the same input terminal 14. FIGS. 3A to 3D and 4A to 4D illustrate exemplary sequences of driving the display panel according to this embodiment. The drive voltages are written to the associated pixels in sequences shown in FIGS. 3A to 3D and 4A to 4D. For achieving the pixels in the sequence, the pixel data are fed from the latch circuit 23 to the D/A converter 24 in the order corresponding to the sequences shown in FIGS. 3A to 3D and 4A to 4D. This allows the drive voltages to be transferred from the amplifiers 25 to the input terminals 14 in the desired sequence of driving the pixels. The drive voltages received by the input terminal 14 are then dispatched through the switches 13 to the associated pixels. A preferred embodiment of the display panel driving method according to the present invention will be described below in more detail.

(1) Glossaries

The terms and symbols used in this specification will now be described. For defining the terms and symbols in a general form, the number of pixel sets associated with the same input terminal 14 is represented as "N".

1-a) Ordinal Numbers

The sequence of drive voltages into the N×3 pixels positioned along the same scanning line and connected to the same input terminal 14 is represented by a set of ordinal numbers that are integers ranging from 1 to N×3. As N is two in this embodiment, the sequence of drive voltages into six pixels (that is, $R_1$, $G_1$, $B_1$, $R_2$, $G_2$, and $B_2$ pixels) along the $i^{th}$ scanning line is expressed by a set of ordinal numbers $\alpha_{i1}^R$, $\alpha_{i1}^G$, $\alpha_{i1}^B$, $\alpha_{i2}^R$, $\alpha_{i2}^G$, and $\alpha_{i2}^B$, which are respectively associated with the $R_1$, $G_1$, $B_1$, $R_2$, $G_2$ and $B_2$ pixels, where the ordinal numbers $\alpha_{i1}^R$, $\alpha_{i1}^G$, $\alpha_{i1}^B$, $\alpha_{i2}^R$, $\alpha_{i2}^G$, and $\alpha_{i2}^B$, are different integers from 1 to 6. More particularly, the ordinal number $\alpha_{i1}^R$ represents that the $R_1$ pixel on the $i^{th}$ scanning line is driven $\alpha_{i1}^R$-th earliest during the drive sequence. The same goes for the other ordinal numbers $\alpha_{i1}^G$, $\alpha_{i1}^B$, $\alpha_{i2}^R$, $\alpha_{i2}^G$, and $\alpha_{i2}^B$. In an example shown in FIG. 3A, for example, the ordinal numbers associated with the $R_1$ pixel, the $G_1$, pixel, the $B_1$ pixel, the $R_2$ pixel, the $G_2$ pixel, and the $B_2$ pixel connected along the $n^{th}$ scanning line are 1, 5, 2, 3, 6, and 4, respectively. Then, the write sequence is expressed by a set of ordinal numbers $\alpha_{n1}^R$, $\alpha_{n1}^G$, $\alpha_{n1}^B$, $\alpha_{n2}^R$, $\alpha_{n2}^G$, and $\alpha_{n2}^B$, satisfying:

$$\alpha_{n1}^R=1,$$

$$\alpha_{n1}^G=5,$$

$$\alpha_{n1}^B=2,$$

$$\alpha_{n2}^R=3,$$

$$\alpha_{n2}^G=6, \text{ and}$$

$$\alpha_{n2}^B=4.$$

For identifying the frame, the ordinal numbers $\alpha_{i1}^R$, $\alpha_{i1}^G$, $\alpha_{i1}^B$, $\alpha_{i2}^R$, $\alpha_{i2}^G$, and $\alpha_{i2}^B$ may be each accompanied with an additional subscribe. For example, the $R_1$ pixel, the $G_1$, pixel, the $B_1$ pixel, the $R_2$ pixel, the $G_2$ pixel, and the $B_2$ pixel in the $k^{th}$ frame of the $n^{th}$ scanning line are expressed in a sequence by $\alpha^k_{i1}{}^R$, $\alpha^k_{i1}{}^G$, $\alpha^k_{i1}{}^B$, $\alpha^k_{i2}{}^R$, $\alpha^k_{i2}{}^G$, and $\alpha^k_{i2}{}^B$.

1-b) Drive Sequence Matrix

A drive sequence matrix is defined as a (p, N×3)-matrix whose elements are composed of ordinal numbers of associated pixels, p being a natural number. For example, the drive sequences for the pixels arranged in the $n^{th}$ and $(n+1)^{th}$ lines are expressed by a (2, 6) drive sequence matrix $X_{n,(n+1)}$ represented as follows:

$$X_{n,(n+1)} = \begin{pmatrix} \alpha_{n1}^R & \alpha_{n1}^G & \alpha_{n1}^B & \alpha_{n2}^R & \alpha_{n2}^G & \alpha_{n2}^B \\ \alpha_{(n+1)1}^R & \alpha_{(n+1)1}^G & \alpha_{(n+1)1}^B & \alpha_{(n+1)2}^R & \alpha_{(n+1)2}^G & \alpha_{(n+1)2}^B \end{pmatrix},$$

1-c) Drive Sequence

The drive sequence of the $i^{th}$ line means the order of driving N×3 pixels positioned in the $i^{th}$ line, connected to the same input terminal 14, and is expressed by a set of ordinal numbers associated with the relevant pixels, or a (1, N×3) drive sequence matrix. With N being two in this embodiment, the writing sequence on the $i^{th}$ line is a sequence of the six pixels of $R_1$, $G_1$, $B_1$, $R_2$, $G_2$, and $B_2$ to be driven with the drive voltages and thus expressed by a (1, 6) drive sequence matrix.

Similarly, the drive sequence of the pixel set $P_{ij}$ is the order of driving the $R_j$ pixel $C_{ij}^R$, the $G_j$ pixel $C_{ij}^G$, and the $B_j$ pixel $C_{i3}^B$ in the pixel set $P_{ij}$.

It is hence defined to determine whether the drive sequence is identical or different between two scanning lines as follows: The drive sequence is identical between two lines when all the elements in the associated drive sequence matrixes are identical between the two lines. When any elements in the associated drive sequence matrixes are different, the drive sequences are defined as being different between the two lines. The same goes for the drive sequences of the pixel sets.

1-d) Partial Drive Sequence Matrix

A partial drive sequence matrix, which is a partial matrix of a drive sequence matrix, is a (p, N) matrix for indicating the ordinal numbers of pixels associated with a specific color, p being the number of rows of the drive sequence matrix, that is, the number of associated lines. With N being two in this embodiment, a partial drive sequence matrix $X^R_{(n,n+1)}$ defined for the R pixels along the $n^{th}$ line and the $(n+1)^{th}$ line is expressed by:

$$X^R_{n,n+1} = \begin{pmatrix} \alpha^R_{n1} & \alpha^R_{n2} \\ \alpha^R_{(n+1)1} & \alpha^R_{(n+1)2} \end{pmatrix},$$

where an $\alpha_{n1}{}^R$ and $\alpha_{(n+1)1}{}^R$ are the ordinal numbers of the $R_1$ pixels along the $n^{th}$ line and the $(n+1)^{th}$ line, respectively, and $\alpha_{n2}{}^R$ and $\alpha_{(n+1)2}{}^R$ are the ordinal numbers of the $R_2$ pixels along the $n^{th}$ line and the $(n+1)^{th}$ line, respectively. Similarly, a partial drive sequence matrix $X^G_{n,n+1}$ defined for the G pixels along the $n^{th}$ line and the $(n+1)^{th}$ line is expressed by:

$$X^G_{n,n+1} = \begin{pmatrix} \alpha^G_{n1} & \alpha^G_{n2} \\ \alpha^G_{(n+1)1} & \alpha^G_{(n+1)2} \end{pmatrix},$$

Finally, a partial drive sequence matrix $X^B_{(n,n+1)}$ of the B pixels along the $n^{th}$ line and the $(n+1)^{th}$ line is expressed by:

$$X^B_{n,n+1} = \begin{pmatrix} \alpha^B_{n1} & \alpha^B_{n2} \\ \alpha^B_{(n+1)1} & \alpha^B_{(n+1)2} \end{pmatrix},$$

1-e) Coordinate System

An x-y coordinate system is defined on the liquid crystal panel 10. The x axis is defined as extending in a horizontal direction, in parallel with the scanning line $G_i$. The y axis is defined as extending in a vertical direction, in parallel with the signal lines. More specifically, the positive x direction is a direction along the scanning lines. The negative x direction is a reverse of the positive x direction.

The method of driving the display panel according to the present invention will be described in more detail referring to the terms and symbols explained above.

(2) Principle of Display Panel Driving Method of the Present Invention

The display panel driving method of the present invention is based on the fact that the change in the drive voltages across the pixels depends on the order of driving the pixels. For example, when a set of the pixels $R_1$, $G_1$, $B_1$, $R_2$, $G_2$, and $B_2$ positioned in the $n^{th}$ line are driven in this order, the pixels $R_1$, $G_1$, $B_1$, $R_2$, $G_2$, and $B_2$ experience increased changes in the drive voltages in the same order.

As illustrated in FIGS. 3A to 3F, the display panel driving method of this embodiment, which makes use of this phenomenon, effectively eliminates vertical segments of uneven brightness through defining the drive sequences of the respective lines so that the drive sequences of any two adjacent lines are different from each other. More specifically, the drive sequences of the pixels positioned in the $n^{th}$ and $(n+1)^{th}$ lines are determined so that the following equation holds for at least one column of the associated drive sequence matrix $X_{n,(n+1)}$:

$$\alpha_{nj}{}^{\gamma} \neq \alpha_{(n+1)j}{}^{\gamma}, \tag{1-1}$$

where j is 1 or 2 and γ is any of "R", "G", and "B". For an example shown in FIG. 3A, the ordinal number $\alpha_{n1}{}^R$ of the $R_1$ pixel on the $n^{th}$ line is "1", while the ordinal number $\alpha_{(n+1)1}{}^R$ of the $R_1$ pixel on the $(n+1)^{th}$ line is "4".

In order to eliminate the vertical segments of uneven brightness more effectively, it is more preferable that the ordinal number of each pixel positioned in a specific line is determined as being different from the corresponding pixel of the adjacent line. More particularly, it is preferred that the formula (1-1) holds for all the columns of the drive sequence matrix $X_{(n,n+1)}$, defined for the $n^{th}$ line and the $(n+1)^{th}$ line. In the example shown in FIG. 3A, the ordinal numbers associated with the six pixels $R_1$, $G_1$, $B_1$, $R_2$, $G_2$, and $B_2$ positioned in the $n^{th}$ line are "1", "5", "2", "3", "6", and "4", respectively, while the ordinal numbers associated with the corresponding six pixels positioned the $(n+1)^{th}$ line are "4", "6", "3", "2", "5", and "1"; the ordinal numbers are different between the $n^{th}$ line and the $(n+1)^{th}$ line for each of the $R_1$, $G_1$, $B_1$, $R_2$, $G_2$, and $B_2$ pixels.

Figure 3A:
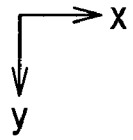
FIG. 3A illustrates an exemplary drive sequence of each line in the first embodiment.
Figure 3B:
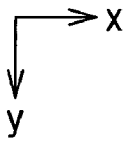
FIG. 3B illustrates another exemplary drive sequence of each line in the first embodiment.

The drive sequences may be cycled with a spatial cycle of two lines (referred to as the line cycle, hereinafter) as shown in FIGS. 3A and 3B, and with a spatial cycle of four lines as shown in FIGS. 3C to 3F. An increased spatial cycle is preferable for effectively eliminating the uneven brightness, because this allows pixels experiencing increased changes in the drive voltages to be spatially scattered over a wider area.

There is an additional requirement for the display panel driving method of this embodiment; the ordinal numbers of the G pixels are defined not to be smaller than 3 (=N+1) for each line. Referring to FIG. 3A, for example, the six pixels positioned in the $n^{th}$ line are driven in this order of the $R_1$, $B_1$, $R_2$, $B_2$, $G_1$, and $G_2$ pixels; the two G pixels are driven fifth and sixth earliest in the sequence. For the example shown in FIG. 3B, the six pixels positioned in the $n^{th}$ line are driven in this order of $R_1$, $B_1$, $G_1$, $G_2$, $R_2$, and $B_2$; the two G pixels are driven third and fourth earliest.

This requirement is substantially favorable for improving the quality of images reproduced on the display panel 10. This is explained by the fact that the spectral luminous efficacy of human vision exhibits the higher value for green (G), compared to red (R) and blue (B). As the spectral luminous efficacy of human vision is higher at the wavelength of green (G), changes in the drive voltages across the G pixels are most easily perceived as vertical segments of uneven brightness on the liquid crystal display panel 10. When the G pixels are driven earlier than the other color pixels, the changes in the drive voltages across the G pixels would be emphasized, thus enhancing the generation of vertical segments of uneven brightness. On the other hand, when the ordinal numbers of the G pixels is defined not to be smaller than 3 (=N+1) in the drive sequence, this effectively reduces the vertical segments of uneven brightness, hence improving the image quality.

The ordinal numbers of the G pixels are determined dependent on image quality requirements of the liquid crystal panel 10. When elimination of uneven brightness is mainly required for the liquid crystal panel 10, the ordinal numbers of the G pixels are determined as being equal to or more than 5 (=2N+1), as shown in FIG. 3A. Driving the G pixels at the later stage effectively reduces the changes in the drive voltages across the G pixels, exhibiting the highest spectral luminous efficacy, and thereby eliminates uneven brightness.

On the other hand, when the uniformity of colors is primarily required for the liquid crystal panel 10, the two G pixels are preferably driven at an intermediate stage during the drive sequence; namely, the ordinal numbers of the two G pixels are selected as "3" (=N+1), or "4" (=2N), as shown in FIG. 3B. As the two G pixels are driven at the intermediate stage of the drive sequence, the drive voltage changes across the G pixels are close to the average of the six pixels, thus improving the uniformity of colors reproduced on the liquid crystal panel 10.

It is desirable that the ordinal numbers of the G pixels are assigned to be consecutive; this preferably suppresses the generation of granular pattern and flicker within the image on the liquid crystal panel 10; as the two G pixels, exhibiting the highest spectral luminous efficacy, are driven at a significant time interval, this may generate perceivable granular patterns and/or flickers. For avoiding the generation of granular patterns and flickers, the G pixels are desirably driven consecutively in the drive sequence. For example, the example shown in FIG. 3A illustrates the drive sequences of the two pixels $G_1$ and $G_2$ assigned with the ordinal numbers of "5" and "6" or vice versa. In the example shown in FIG. 3B, the two pixels $G_1$ and $G_2$ are assigned with the ordinal numbers of "3" and "4" or vice versa.

It is more desirable for further eliminating vertical and horizontal segments of uneven brightness, that the drive sequences are defined so that the ordinal numbers of R pixels positioned in the same column are different from one another over a single line cycle. In the example shown in FIG. 3C, exhibiting a line cycle of four lines, the ordinal numbers $\alpha_{n1}{}^R$ to $\alpha_{(n+3)1}{}^R$ of the $R_1$ pixels aligned along the same column over the $n^{th}$ to $(n+3)^{th}$ lines are different from one another; the ordinal numbers $\alpha_{n1}{}^R$ to $\alpha_{(n+3)1}{}^R$ are defined as being "1", "4", "3", and "2", respectively. Correspondingly, the ordinal numbers $\alpha_{n2}{}^R$ to $\alpha_{(n+3)2}{}^R$ of the $R_2$ pixels positioned in the $n^{th}$ to $(n+3)^{th}$ lines are different from one another.

It is further desirable for eliminating the generation of uneven brightness that the sums of the ordinal numbers of the R pixels in the same columns over each line cycle are constant. More specifically, it is desired that the sum of the ordinal numbers of the $R_1$ pixels and the sum of the ordinal numbers of the $R_2$ pixels over the same line cycle are identical to each other. This will evenly scatter the pixels experiencing increased drive voltage changes, hence improving the uniformity of brightness.

For the case when the line cycle is two lines, the ordinal numbers of the four R pixels positioned in the $n^{th}$ and $(n+1)^{th}$ lines are preferably determined as being crossed from each other. Mathematically speaking, it is desirable that the (1,1), (2,2), (1,2), and (2,1) elements of the partial writing sequence matrix of the R pixels for the $n^{th}$ and $(n+1)^{th}$ lines are determined as being incrementally or decrementally cyclic. For the drive sequence of FIG. 3A, for example, the partial drive sequence matrix $X^R_{(n,\ n+1)}$ of the R pixels for the $n^{th}$ and $(n+1)^{th}$ lines is expressed by the following equation (1-2):

$$X^R_{n,n+1} = \begin{pmatrix} 1 & 3 \\ 4 & 2 \end{pmatrix}, \tag{1-2}$$

More particularly, the (1,1) element $\alpha_{n1}{}^R$, the (2,2) element $\alpha_{(n+1)2}{}^R$, the (1,2) element $\alpha_{(n+1)2}{}^R$, and the (2,1) element $\alpha_{(n+1)1}{}^R$ are "1", "2", "3", and "4", respectively. Hence, the (1,1), (2,2), (1,2), and (2,1) elements are determined as being incrementally cyclic.

Correspondingly, for the case when the line cycle is four lines, the ordinal numbers of the four R pixels positioned in the $n^{th}$ and $(n+1)^{th}$ lines are preferably determined as being crossed from each other, and the ordinal numbers of the four R pixels positioned in the $(n+2)^{th}$ and $(n+3)^{th}$ lines are determined as being crossed from each other. In the example shown in FIG. 3C, the partial drive sequence matrix $X^R_{(n,\ n+1)}$ is expressed by Equation (1-2). As described above, the (1,1), (2,2), (1,2), and (2,1) elements are determined as being incrementally cyclic. Correspondingly, the partial drive sequence matrix $X^R_{(n+2),\ (n+3)}$ of the R pixels for the $(n+2)^{th}$ and $(n+3)^{th}$ lines is expressed by the following equation (1-3):

$$X^R_{n+2,n+3} = \begin{pmatrix} 3 & 1 \\ 2 & 4 \end{pmatrix}, \tag{1-3}$$

More particularly, the (1,1) element $\alpha_{n1}{}^R$, the (2,2) element $\alpha_{(n+1)2}{}^R$, the (1,2) element $\alpha_{(n+1)2}{}^R$, and the (2,1) element $\alpha_{(n+1)1}{}^R$ are "3", "4", "1", and "2" respectively. Hence, the (1,1), (2,2), (1,2), and (2,1) elements are also determined as being incrementally cyclic.

The same goes for the ordinal numbers of the B pixels. The ordinal numbers of the B pixels positioned in the same column are preferably different from one another over a single line cycle. Additionally, the ordinal numbers of the four B pixels positioned in the $n^{th}$ and $(n+1)^{th}$ lines are preferably determined as being crossed from each other, and for the case when the line cycle is four lines, the ordinal numbers of the four B pixels positioned in the $(n+2)^{th}$ and $(n+3)^{th}$ lines are determined as being crossed from each other.

It is also desirable for eliminating the uneven brightness that the sum of the ordinal numbers of the R pixels aligned along each column over a line cycle is equal to the sum of the ordinal numbers of the B pixels aligned along each column over the line cycle; specifically, it is desired that the sum of the ordinal numbers of the $R_1$ pixels, the sum of the ordinal numbers of the $R_2$ pixels, the sum of the ordinal numbers of the $B_1$ pixels, and the sum of the ordinal numbers of the $B_2$ pixels for the same line cycle are all identical. This will evenly scatter the pixels experiencing increased changes in the drive voltages thereacross, hence improving the uniformity of brightness throughout the image reproduced.

This will be explained in more detail using the ordinal numbers $\alpha_{ij}{}^\gamma$. For the case when the line cycle is two lines, the drive sequences for the relevant line cycle are determined so that the following equation (1-4a) is established:

$$\begin{aligned} \alpha^R_{nI} + \alpha^R_{(n+1)1} &= \alpha^B_{n1} + \alpha^B_{(n+1)1}, \\ &= \alpha^R_{n2} + \alpha^R_{(n+1)2}, \\ &= \alpha^B_{n2} + \alpha^B_{(n+1)2}, \\ &= K_L. \end{aligned} \tag{1-4a}$$

The parameter $K_l$ is 4 for the case of the example of FIG. 3A, while $K_L$ is 7 for the case of the example of FIG. 3B.

For the case when the line cycle is four lines, on the other hand, the drive sequences of the pixels are determined so that the following equation (1-4b) is established:

$$\sum_{i=n}^{n+3} \alpha^R_{i1} = \sum_{i=n}^{n+3} \alpha^B_{i1} = \sum_{i=n}^{n+3} \alpha^R_{i2} = \sum_{i=n}^{n+3} \alpha^B_{i2} = K'_L, \tag{1-4b}$$

Figure 3C:
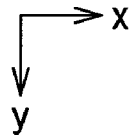
FIG. 3C illustrates still another exemplary drive sequence of each line in the first embodiment.
Figure 3D:
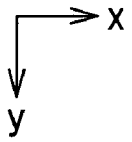
FIG. 3D illustrates still another exemplary drive sequence of each line in the first embodiment.

The parameter $K_L'$ is 10 for the case of the example of FIG. 3C, while $K_L'$ is 14 for the case of the example of FIG. 3D.

Additionally, for the case when the ordinal numbers of the G pixels are selected as being 3 and 4, as shown in FIG. 3D, it is preferable that the sums of the ordinal numbers of the pixels aligned in the same column over a line cycle, including the G pixels, are identical. More specifically, for the case when the line cycle is two lines, the following equation (1-4c) is preferably established:

$$\sum_{i=n}^{n+1} \alpha_{i1}^{R} = \sum_{i=n}^{n+1} \alpha_{i1}^{G} = \sum_{i=n}^{n+1} \alpha_{i1}^{B} = \sum_{i=n}^{n+1} \alpha_{i2}^{R} = \sum_{i=n}^{n+1} \alpha_{i2}^{G} = \sum_{i=n}^{n+1} \alpha_{i2}^{B} = K_L, \tag{1-4c}$$

For the case when the line cycle is four lines, the following equation (1-4d) is preferably established:

$$\sum_{i=n}^{n+3} \alpha_{i1}^{R} = \sum_{i=n}^{n+3} \alpha_{i1}^{G} = \sum_{i=n}^{n+3} \alpha_{i1}^{B} = \sum_{i=n}^{n+3} \alpha_{i2}^{R} = \sum_{i=n}^{n+3} \alpha_{i2}^{G} = \sum_{i=n}^{n+3} \alpha_{i2}^{B} = K'_L, \tag{1-4d}$$

Figure 4A:
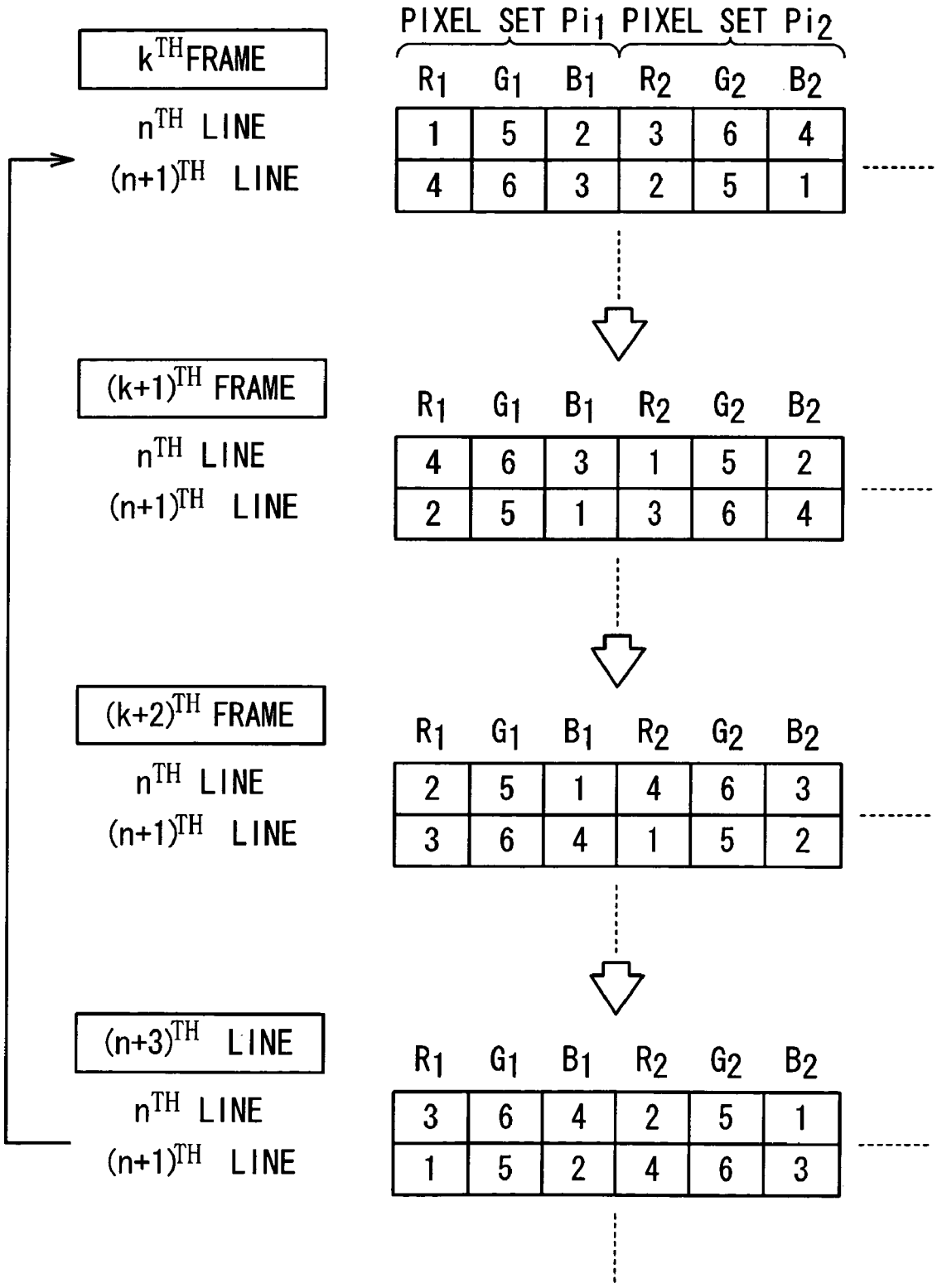
FIG. 4A illustrates an exemplary drive sequence of each line for each frame, based on a frame rate control technique in the first embodiment.

For further eliminating the generation of uneven brightness, a frame rate control technique (FRC) is preferably introduced as shown in FIGS. 4A to 4F, where the drive sequences of the respective lines are switched at every frame. The frame rate control can temporally scatter the pixels experiencing increased changes in the drive voltages thereacross, thus reducing vertical and horizontal segments of uneven brightness. An example is shown in FIG. 4A where the drive sequence of the $n^{th}$ line is different among the four, $k^{th}$, $(k+1)^{th}$, $(k+2)^{th}$, and $(k+3)^{th}$ frames. The same goes for the drive sequence of the $(n+1)^{th}$ line. In the frame rate control, the frame rate control period at which the drive sequences are temporally cycled is equal to 2N frames. In this embodiment, the frame rate control period is four frames.

It is desirable for further eliminating the generation of uneven brightness that the sums of the ordinal numbers of the R and B pixels over each frame rate control period (that is, over the $k^{th}$ to $(k+3)^{th}$ frames) are equal to one another. This is expressed by the following equation (1-5a) using the ordinal number $\alpha^{P}_{ij}{}^{\gamma}$ of the relevant pixel during the p-th frame:

$$\sum_{p=k}^{k+3} \alpha_{i1}^{p\,R} = \sum_{p=k}^{k+3} \alpha_{i1}^{p\,B} = \sum_{p=k}^{k+3} \alpha_{i2}^{p\,R} = \sum_{p=k}^{k+3} \alpha_{i2}^{p\,B} = K_F, \tag{1-5a}$$

where i is any integer. The parameter $K_F$ is 10 for the examples shown in FIGS. 4A and 4C, while $K_F$ is 14 for the examples shown in FIGS. 4B and 4D.

Additionally, for the case when the ordinal numbers $\alpha^{P}_{i2}$ and $\alpha^{P}_{i5}$ of the G pixels are selected as being 3 and 4 (See FIGS. 4B and 4D), the sums of the ordinal numbers of the R, G, and B pixels over each frame rate control period are equal to one another. In other words, the following equation (1-5b) holds for i being an arbitrary number:

$$\sum_{p=k}^{k+3} \alpha_{i1}^{p\,R} = \sum_{p=k}^{k+3} \alpha_{i1}^{p\,G} = \sum_{p=k}^{k+3} \alpha_{i1}^{p\,B} = \sum_{i=n}^{n+3} \alpha_{i2}^{p\,R} = \sum_{i=n}^{n+3} \alpha_{i2}^{p\,G} = \sum_{i=n}^{n+3} \alpha_{i2}^{p\,B} = K'_F, \tag{1-5b}$$

(3) Procedure of Determining the Drive Sequence of Each Line

Figure 5A:
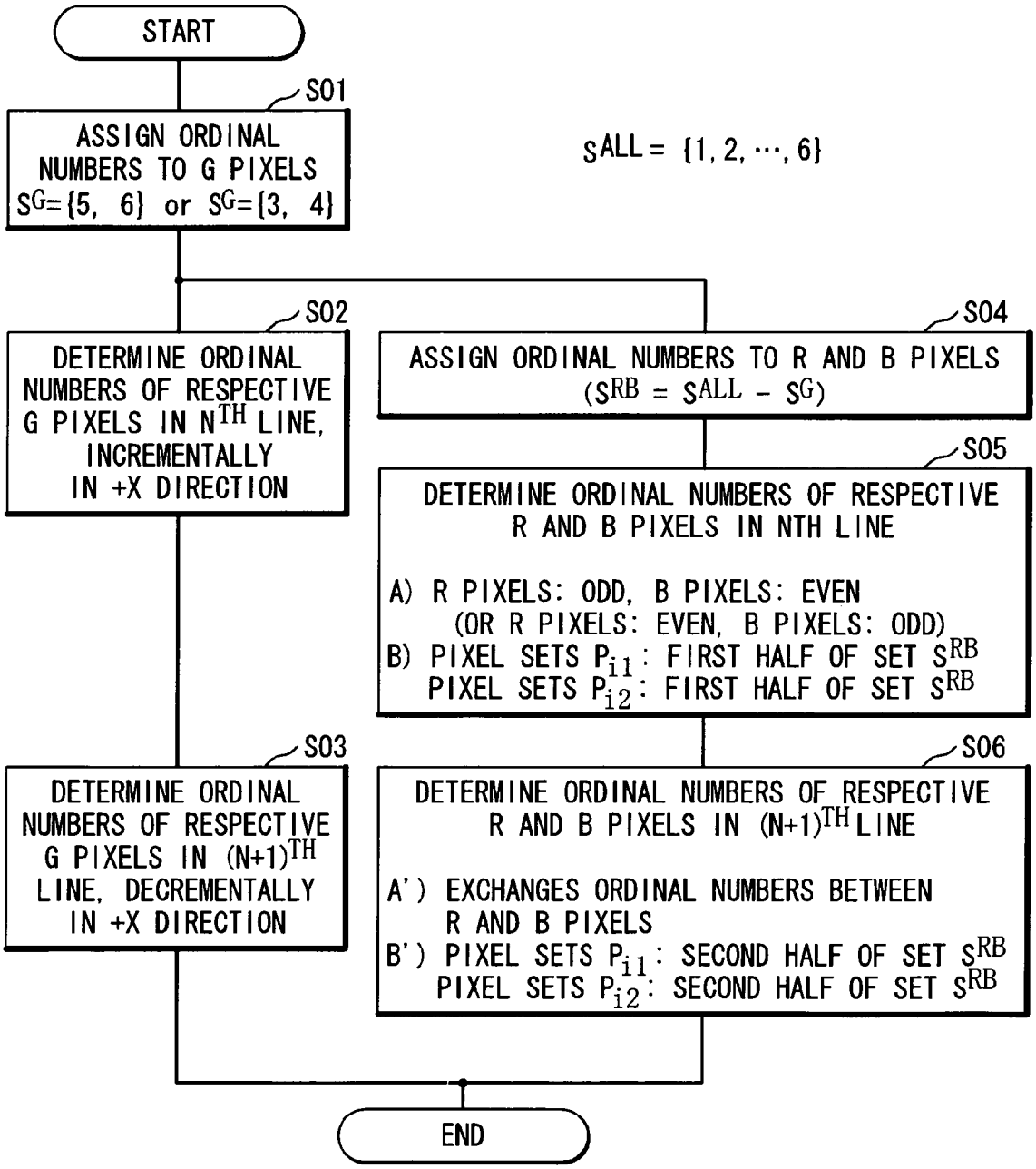
FIG. 5A is a flowchart showing a first algorithm for determining the drive sequence of each line in the first embodiment for the case when the line cycle is two lines.

FIG. 5A is a flowchart showing a first algorithm for determining the drive sequence of each line in order to satisfy the above described requirements. The first algorithm shown in FIG. 5A is provided for determining the drive sequence shown in FIGS. 3A and 3B. It should be noted that the line cycle is two lines for the examples shown in FIGS. 3A and 3B, and that the first algorithm determines the drive sequence of the $n^{th}$ line and the drive sequence of the $(n+1)^{th}$ line.

In the first algorithm, ordinal numbers are firstly assigned to the G pixels at Step S01. In the example shown in FIG. 3A, the G pixels are assigned with the ordinal numbers from 2N+1 to 3N, namely 5 or 6. In FIG. 3B, the G pixels are assigned with the ordinal numbers of the writing sequences from N+1 to 2N, namely 3 or 4.

The ordinal numbers of the G pixels of the $n^{th}$ line are determined as being incremental in the +x direction at Step S02. More particularly in the example shown in FIG. 3A, the $G_1$ and $G_2$ pixels of the $n^{th}$ line are assigned with the ordinal numbers of "5" and "6", respectively. In the example of FIG. 3B, the $G_1$ and $G_2$ pixels of the $n^{th}$ line are assigned with the ordinal numbers of "3" and "4", respectively.

The ordinal numbers of the G pixels of the $(n+1)^{th}$ line, on the other hand, are determined as being decremental in the +x direction (or incremental in the −x direction) at Step S03. More particularly, in the example shown in FIG. 3A, the $G_1$ and $G_2$ pixels of the $n^{th}$ line are assigned with the ordinal numbers of "6" and "5", respectively. In the example of FIG. 3B, the $G_1$ and $G_2$ pixels of the $n^{th}$ line are assigned with the ordinal numbers of "4" and "3", respectively.

At Step S04, the R and B pixels are then assigned with the remaining ordinal numbers, which are not assigned to the G pixels. In the example shown in FIG. 3A, the R and B pixels are assigned with the ordinal numbers of "1" to "4". In the example of FIG. 3B, the R and B pixels are assigned with the ordinal numbers of "1", "2", "5", and "6".

The ordinal numbers of the R and B pixels of the $n^{th}$ line is determined at Step S05 so that the following requirements are satisfied:

(a) the ordinal numbers of the R pixels are either odd or even numbers, and the ordinal numbers of the B pixels are the others, and (b) the ordinal numbers of the pixels within the pixel sets $P_{i1}$, are selected from a first half of the ordinal numbers assigned to the R and B pixels at Step S04, and the ordinal numbers of the pixels within the pixel sets $P_{i2}$ are selected from the second half of the assigned ordinal numbers.

More specifically, in both of the examples shown in FIGS. 3A and 3B, the R pixels are assigned with odd ordinal numbers while the B pixels are assigned with even ordinal numbers. In the example of FIG. 3A, the $R_1$ and $B_1$ pixels within the pixel set $P_{i1}$ of the $n^{th}$ line are assigned with the ordinal numbers of "1" and "2", respectively, while the $R_2$ and $B_2$ pixels within the pixel set $P_{i2}$ are assigned with the ordinal numbers of "3" and "4", respectively. In the example of FIG. 3B, the $R_1$ and $B_1$ pixels of the $n^{th}$ line are assigned with the ordinal numbers of "1" and "2", respectively, while the $R_2$ and $B_2$ pixels are assigned with the ordinal numbers of "5" and "6", respectively.

The ordinal numbers of the R and B pixels of the $(n+1)^{th}$ line, on the other hand, are determined at Step S06 so that the following requirements are satisfied: (a') the ordinal numbers of the R pixels are exchanged with the ordinal numbers of the B pixels, and (b') the ordinal numbers of the pixels within the pixel set $P_{i1}$, are selected from the second half of the ordinal numbers assigned to the R and B pixels at Step S04, and the ordinal numbers of the pixels within the pixel set $P_{i2}$ are selected from the first half of the assigned ordinal numbers.

More specifically in the example of FIG. 3A, the $R_1$ and $B_1$ pixels within the pixel set $P_{i1}$, are assigned with the ordinal numbers of "4" and "3", respectively, while the $R_2$ and $B_2$ pixels within the pixel set $P_{i2}$ are assigned with the ordinal numbers of "2" and "1", respectively. In the example of FIG. 3B, on the other hand, the $R_1$ and $B_1$ pixels within the pixel set $P_{i1}$, are assigned with the ordinal numbers of "6" and "5", respectively, while the $R_2$ and $B_2$ pixels are assigned with the ordinal numbers of "2" and "1", respectively.

Determining the ordinal numbers of the R and B pixels of the $n^{th}$ line and the $(n+1)^{th}$ line in this manner results in that the ordinal numbers of the four R pixels are determined as being crossed between the $n^{th}$ line and the $(n+1)^{th}$ line, and that the ordinal numbers of the four B pixels are also crossed between the two lines.

Figure 5B:
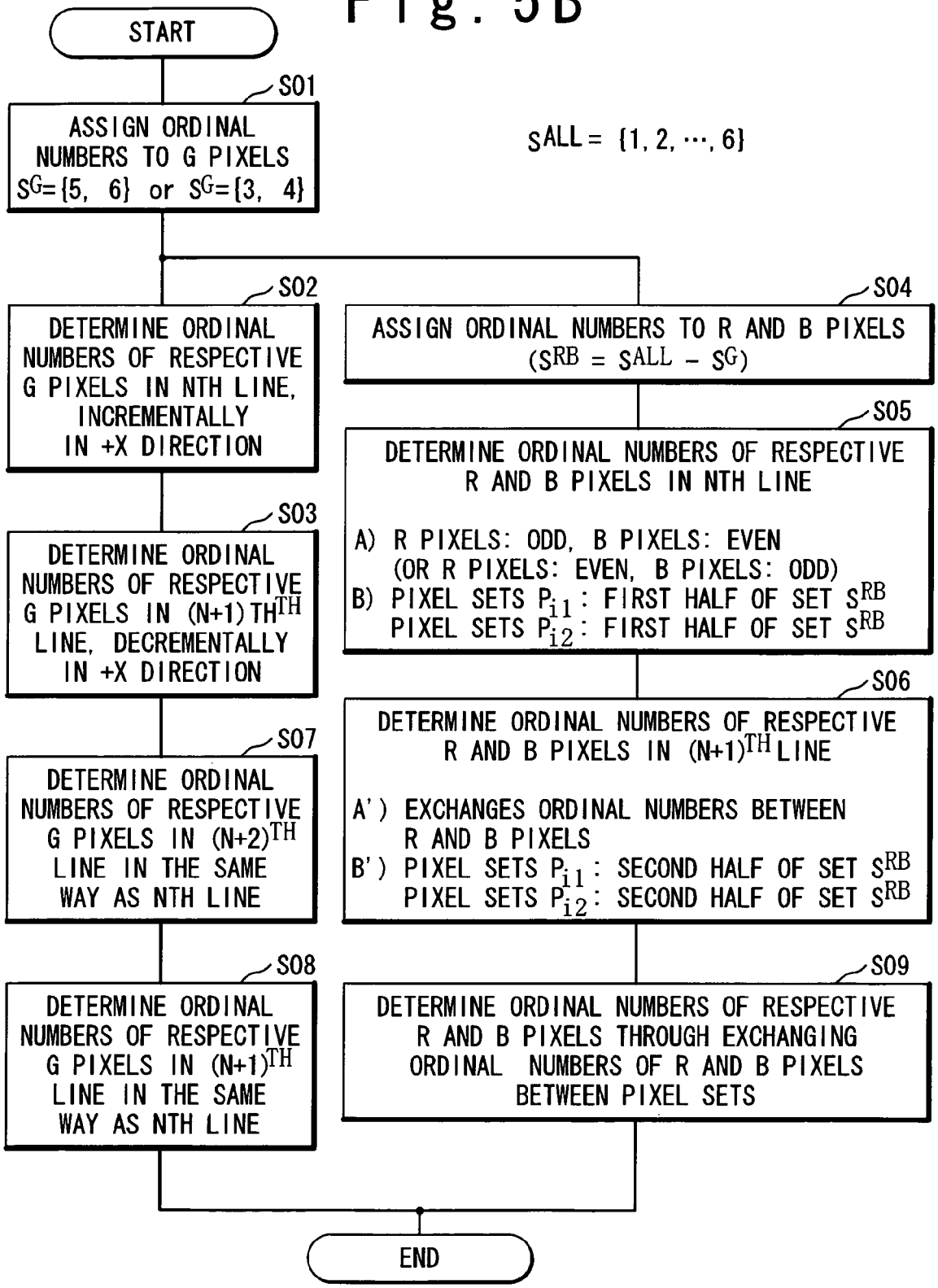
FIG. 5B is a flowchart showing the second algorithm for determining the drive sequence of each line in the first embodiment for the case when the line cycle is four lines.

FIG. 5B is a flowchart showing a second algorithm for determining the drive sequence of each line when the line cycle is four lines in the first embodiment. The second algorithm shown in FIG. 5B addresses determining the drive sequence of each line for the examples shown in FIGS. 3C and 3D. It should be noted that the line cycle is four lines in the examples shown in FIGS. 3C and 3D, and the second algorithm determines the drive sequences of the $n^{th}$ to $(n+3)^{th}$ lines.

At Steps S01 to S06, the drive sequences of the $n^{th}$ line and the $(n+1)^{th}$ line are determined in the same way as the algorithm described with FIG. 5A.

At Steps S07 to S09, the drive sequences of the $(n+2)^{th}$ line and the $(n+3)^{th}$ line are determined. More particularly, the ordinal numbers of the G pixels of the $(n+2)^{th}$ line are determined in the same manner as the $n^{th}$ line at Step S07. Additionally, the ordinal numbers of the G pixels of the $(n+3)^{th}$ line are determined in the same manner as the $(n+1)^{th}$ line at Step S08.

Moreover, the ordinal numbers of the R and B pixels of the $(n+2)^{th}$ line and the $(n+3)^{th}$ line are determined at Step S09 by exchanging the ordinal numbers of the R and B pixels of the $n^{th}$ and $(n+1)^{th}$ lines between the pixel sets. More specifically, the ordinal numbers of the R and B pixels positioned in the $(n+2)^{th}$ line and the $(n+3)^{th}$ line are determined so as to satisfy the following equations (1-6a) to (1-6h):

$$\alpha_{(n+2)1}{}^{R}=\alpha_{n2}{}^{R}, \tag{1-6a}$$

$$\alpha_{(n+2)1}{}^{B}=\alpha_{n2}{}^{B}, \tag{1-6b}$$

$$\alpha_{(n+2)2}{}^{R}=\alpha_{n1}{}^{R}, \tag{1-6c}$$

$$\alpha_{(n+2)2}{}^{B}=\alpha_{n1}{}^{B}, \tag{1-6d}$$

$$\alpha_{(n+3)1}{}^{R}=\alpha_{(n+1)2}{}^{R}, \tag{1-6e}$$

$$\alpha_{(n+3)1}{}^{B}=\alpha_{(n+1)2}{}^{B}, \tag{1-6f}$$

$$\alpha_{(n+3)2}{}^{R}=\alpha_{(n+1)1}{}^{R}, \text{ and} \tag{1-6g}$$

$$\alpha_{(n+3)2}{}^{B}=\alpha_{(n+1)1}{}^{B}. \tag{1-6h}$$

As the ordinal numbers of the R and B pixels positioned in the $(n+2)^{th}$ line and the $(n+3)^{th}$ line are determined in this manner, the requirements previously presented in the former section can be satisfied. Specifically, determining the ordinal numbers of the R and B pixels by the equations (1-6a) to (1-6h) confirms that the ordinal numbers of the pixels $R_1$, $R_2$, $B_1$, and $B_2$ are different among the $n^{th}$ to $(n+3)^{th}$ lines. In addition, the ordinal numbers the four R pixels of the $(n+2)^{th}$ and $(n+3)^{th}$ lines are determined to be crossed, and the ordinal numbers the four B pixels of the $(n+2)^{th}$ and $(n+3)^{th}$ lines are also determined to be crossed.

Figure 4B:
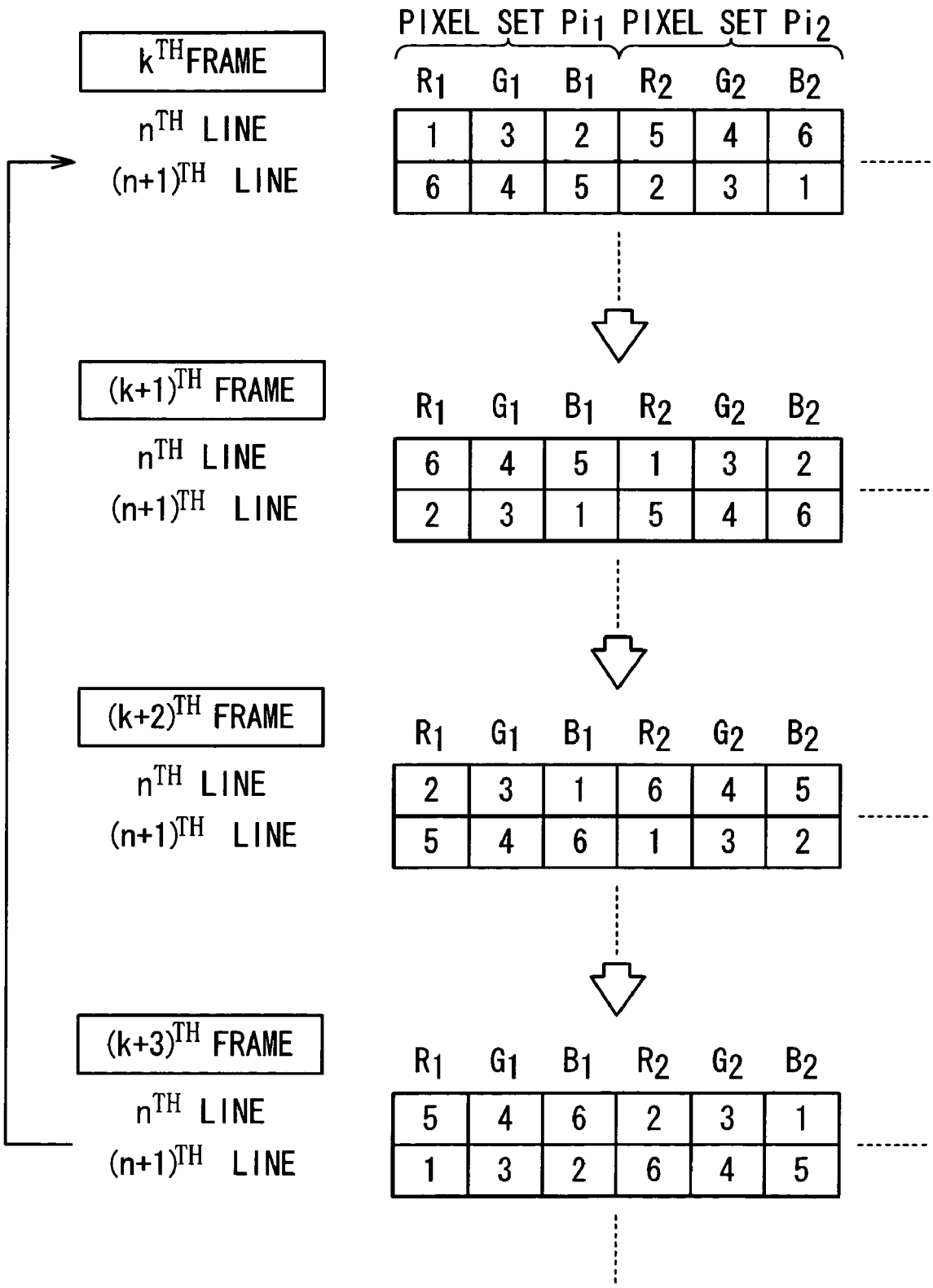
FIG. 4B illustrates another exemplary drive sequence of each line for each frame, based on a frame rate control technique in the first embodiment.

The frame rate control is achieved through clockwisely or counter-clockwisely rotating the elements of the partial drive sequence matrix every frame for the R, G, and B pixel. FIGS. 4A and 4B illustrate the drive sequence of each line when a frame rate control is applied to the examples of FIGS. 3A and 3B, respectively; the line cycle is two lines for these examples. Also, FIGS. 4C and 4D illustrate the drive sequence of each line when a frame rate control is applied to the examples of FIGS. 3C and 3D, respectively; the line cycle is four lines for these examples.

When the line cycle is two lines (See FIGS. 4A and 4B), the frame rate control is achieved through rotating the four elements of the partial drive sequence matrix for the $n^{th}$ and $(n+1)^{th}$ lines, clockwisely (or counter-clockwisely). In the example of FIG. 4A, the partial drive sequence matrix of the R pixels for the $k^{th}$ frame is expressed by:

$$X^{R}_{n,n+1}{}^{k}=\begin{pmatrix}1 & 3\\ 4 & 2\end{pmatrix}, \tag{1-7a}$$

The partial drive sequence matrix $X^{R}_{(n,n+1)(k+1)}$ of the R pixels for the $(k+1)^{th}$ frame, on the other hand, is expressed by:

$$X^{R}_{n,n+1}{}^{k+1}=\begin{pmatrix}4 & 1\\ 2 & 3\end{pmatrix}, \tag{1-7b}$$

which partial matrix is equivalent to the partial drive sequence matrix of the R pixels for the $k^{th}$ frame with the four elements thereof rotated clockwisely. The same goes for the drive sequences for the $(k+2)^{th}$ frame and the $(k+3)^{th}$ frame, and also for the G and B pixels. The four elements of the partial drive sequence matrix may be rotated counter-clockwisely with equal success.

When the line cycle is four lines, the frame rate control is achieved through clockwisely or counter-clockwisely rotating the four elements of the partial drive sequence matrix associated with the $n^{th}$ and $(n+1)^{th}$ lines every frame, and simultaneously rotating the four elements of the partial drive sequence matrix associated with the $(n+2)^{th}$ and $(n+3)^{th}$ lines in the same direction every frame.

As the four elements of the partial drive sequence matrix are rotated every frame, the requirements presented in the former section can be satisfied. Rotating the four elements of the partial drive sequence matrix every frame allows the sums of the ordinal numbers of the pixels over the frame rate control period (that is, over the $k^{th}$ to $(k+3)^{th}$ frames) to be same. In addition, this allows the four R pixels as well as the four B pixels to be crossed between the $n^{th}$ line and the $(n+1)^{th}$ line.

3. Brief Conclusion

In this embodiment, the set of the ordinal numbers are determined as being deferent between any adjacent line for each of the six pixels $R_1$, $G_1$, $B_1$, $R_2$, $G_2$, and $B_2$. This effectively eliminates vertical segments of uneven brightness. Also, the $G_1$ and $G_2$ pixels are assigned with the ordinal numbers equal to or larger than 3 (=N+1). Accordingly, the generation of uneven brightness is further suppressed.

The principle of the display panel driving method of this embodiment is applicable to any display device where the N×3 signal lines are driven in a time-division mode, so long as the properties are not largely diverted, N being a natural number of two or higher. It should be noted, however, the display panel driving method is particularly appropriate for a display device designed to drive six signal lines in a time-divisional manner, in respect of easy control of the drive sequence of each line and easy achievement of the frame rate control.

Second Embodiment

1. General Outline

A display panel driving method of the second embodiment of the present invention is illustrated in FIGS. 6A to 6C, 7A to 7C, 9A to 9C, 11, and 12, where examples of the drive sequence of each line are shown. In the second embodiment, the display panel driving method is modified from that of the first embodiment for driving a display panel in which the number of the pixel sets for each input terminal is 2×K, K being an integer equal to or more than 2; in other word, the display panel driving method of this embodiment addresses driving 6×K signal lines with a single amplifier in a time divisional manner.

The drive sequence of each line in the second embodiment is also determined so as to satisfy the requirements described in the first embodiment. For example, the ordinal number of each pixel in a specific line is determined as being different from that of the corresponding pixel in the adjacent line. Additionally, the ordinal numbers of the G pixels are determined to be equal to or larger than N+1. Specifically, in an example shown in FIG. 6A, the ordinal numbers of the G pixels are determined as being equal to or larger than 2N+2 (also see FIG. 6B). In another example shown in FIG. 7A, on the other hand, the ordinal numbers of the G pixels are determined to range between N+1 and 2N (also see FIG. 7B). Additionally, with respect to the R and B pixels, the ordinal numbers of the pixels positioned in the same column are different from one another over a line cycle. Finally, the drive sequence of each line is determined so that the sums of the ordinal numbers of the pixels positioned in the same columns are identical with respect to the R and B pixels.

In the second embodiment, the line cycle, at which the drive sequences are cycled, is two or 2N (=4K) lines. The procedure of determining the drive sequence of each line will be firstly explained for the case when the line cycle is two lines, and then for the case when the line cycle is 2N lines.

2. For the Case when Line Cycle is Two Lines

The second embodiment with the line period being two lines is shown in FIGS. 6A to 6C and 7A to 7C.

Figure 6C:
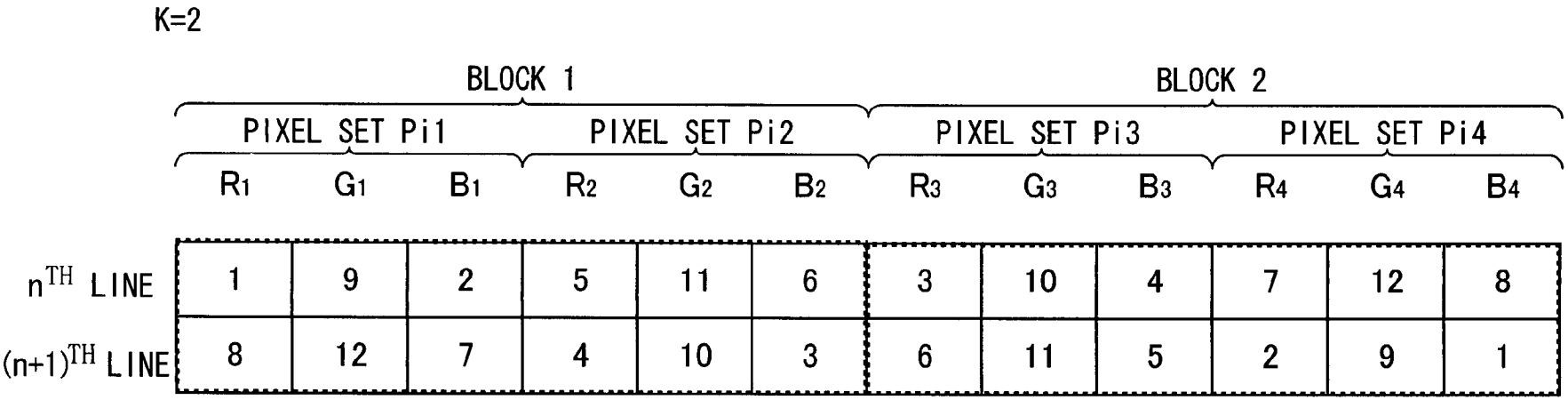
FIG. 6C illustrates an example of the drive sequence of each line of FIG. 6A with K being two.

FIG. 6A illustrates an example where the ordinal numbers of the G pixels are equal to or more than 2N+1. FIG. 6B separately illustrates the ordinal numbers shown in FIG. 6A for the R, G, and B pixels. FIG. 6C illustrates the drive sequence of each line for K being 2 in the example of FIG. 6A.

Figure 7C:
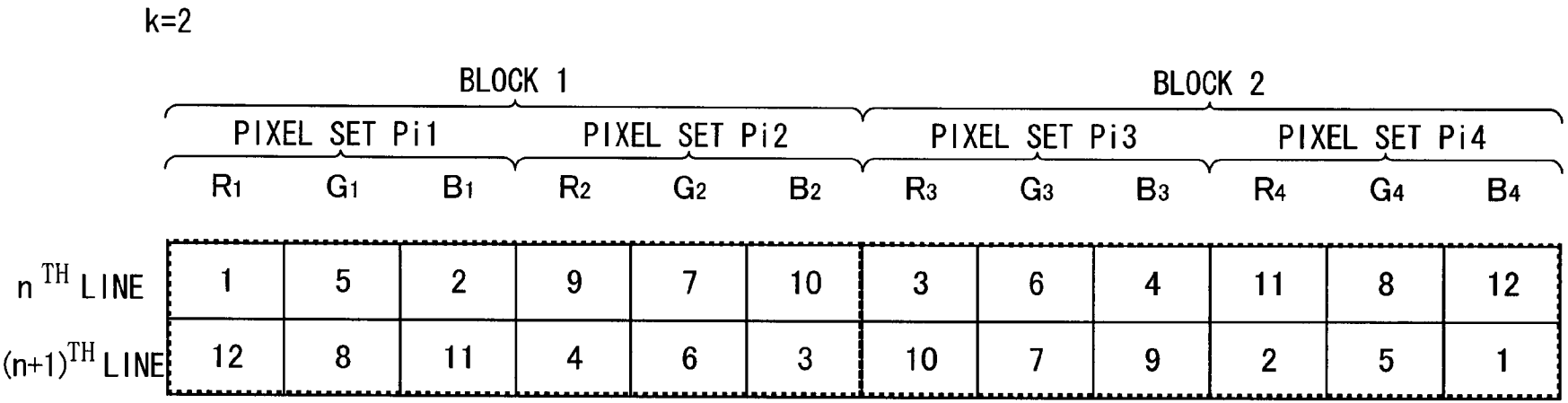
FIG. 7C illustrates an example of the drive sequence of each line of FIG. 7A with K being two.

On the other hand, FIG. 7A illustrates an example where the ordinal numbers of the G pixels ranges from N+1 to 2N. FIG. 7B separately illustrates the ordinal numbers shown in FIG. 7A for the R, G, and B pixels. FIG. 7C illustrates the drive sequence of each line for K being 2 in the example of FIG. 7A.

An algorithm for determining the drive sequence of each line with the line cycle being two lines will now be explained in detail.

(1) Glossary (1-a) Block

The term "block" is used for ease of the description of the display panel driving method of the second embodiment. Referring to FIG. 6A, each block consists of four pixel sets arranged in two rows and two columns. For each line, the N (=2K) pixel sets of each line are associated with the same input terminal 14, and thus, each input terminal 14 is associated with K blocks. A block "j" is defined as being composed of two pixel sets $P_{n(2j-1)}$ and $P_{n(2j)}$ positioned in the $n^{th}$ line and two pixel sets $P_{(n+1)(2j-1)}$ and $P_{(n+1)(2j)}$ positioned in the $(n+1)^{th}$ line. For example, the block "1" is composed of two pixel sets $P_{n1}$ and $P_{n2}$ positioned in the $n^{th}$ line and two pixel sets $P_{(n+1)1}$ and $P_{(n+1)2}$ positioned in the $(n+1)^{th}$ line.

It is noted that the first embodiment is a particular case of the second embodiment with k being 1, that is, the case where the input terminal 14 is connected with one block.

(1-b) Odd-Numbered Pixel Set and Even-Numbered Pixel Set

Odd-numbered pixel sets of the $i^{th}$ line designate odd-numbered ones of N pixel sets $P_{i1}$, to $P_{iN}$ ($P_{i(2K)}$) of the $i^{th}$ line, which are associated with the same input terminal 14. Namely, the pixel sets $P_{i1}$, $P_{i3}$, . . . and $P_{i(2K-1)}$ are odd-numbered pixel sets.

Similarly, even-numbered pixel sets of the $i^{th}$ line designates even-numbered ones of N pixel sets $P_{i1}$ to $P_{iN}$ ($P_{i(2K)}$) of the $i^{th}$ line connected to the same input terminal 14. Namely, the pixel units $P_{i2}$, $P_{i4}$, . . . and $P_{i(2K)}$ are even-numbered pixel sets.

Accordingly, one block consists of two odd-numbered pixel sets aligned vertically and two even-numbered pixel sets adjacent to the two odd-numbered pixel sets.

(2) Description of Algorithm

Figure 8:
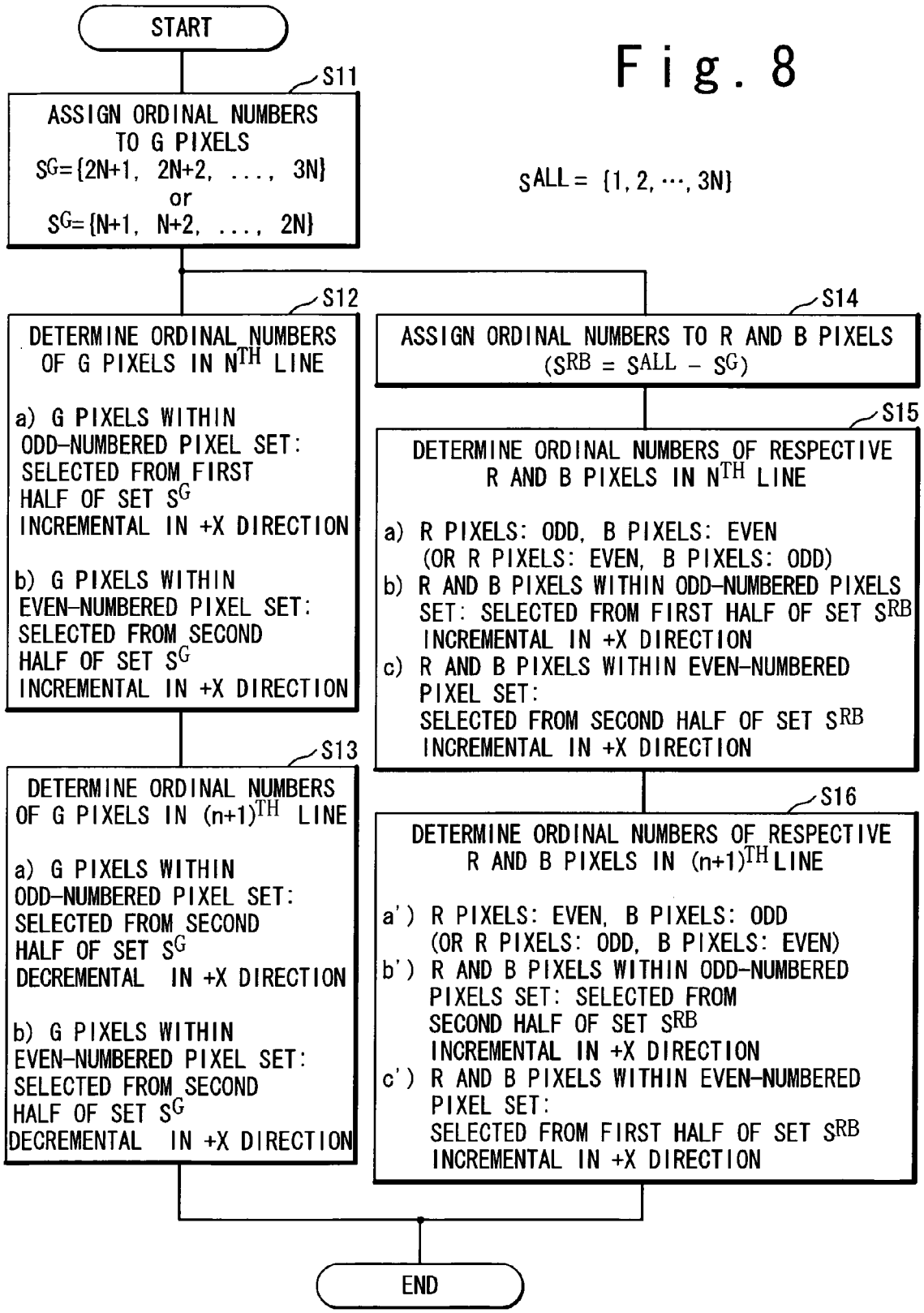
FIG. 8 is a flowchart showing an algorithm for determining the drive sequence of each line in the second embodiment for the case when the line cycle is two lines.

FIG. 8 is a flowchart showing an algorithm for determining the drive sequence of each line for the case when the line cycle is two lines.

In this algorithm, ordinal numbers are firstly assigned to the G pixels at Step S11. For the example shown in FIG. 6A, the G pixels are assigned with the ordinal numbers from 2N+1 to 3N (also see FIG. 6B). For FIG. 7A, the G pixels are assigned with the ordinal numbers from N+1 to 2N (also See FIG. 7B).

It is assumed that a set of the ordinal numbers assigned to the G pixels at Step S11 is denoted by $S^G$ hereinafter. For the example shown in FIG. 6A, the set $S^G$ is expressed by:

$$S^G=\{2N+1, 2N+2, \ldots, 3N\}.$$

For the example shown in FIG. 7A, on the other hand, the set $S^G$ is expressed by:

$$S^G=\{N+1, N+2, \ldots, 2N\}.$$

It is also assumed that a partial set composed of the first half of the elements of the set $S^G$ is denoted by $S^G_L$ and another partial set composed of the second half of the elements of the set $S^G$ is denoted by $S^G_U$. For the example of FIG. 6A, the sets $S^G_L$ and $S^G_U$ are represented by the following equations:

$$S^G_L=\{2N+1, 2N+2, \ldots, 5K\},$$

$$S^G_U=\{5K+1, 5K+2, \ldots, 3N(=6K)\}.$$

For the example of FIG. 7A, $S^G_L$ and $S^G_U$ are represented by the following equations:

$$S^G_L=\{N+1, N+2, \ldots, 3K\},$$

$$S^G_U=\{3K+1, 3K+2, \ldots, 2N(=4K)\}.$$

The ordinal numbers of the G pixels positioned in the $n^{th}$ line is determined at Step S12 so as to satisfy the following requirements:

(1) The ordinal numbers of the G pixels within the odd-numbered pixel sets are selected from the elements of the set $S^G_L$ (which is composed of the first half of the elements of the set $S^G$), and determined to be increased along the +x direction.

(2) The ordinal numbers of the G pixels within the even-numbered pixel sets are selected from the elements of the set $S^G_U$ (which is composed of the second half of the elements of the set $S^G$), and determined to be increased along the +x direction.

Accordingly, the ordinal numbers of the G pixels along the $n^{th}$ line are determined to be increased in this order of the $G_1$ pixel in the block "1", the $G_3$ pixel in the block "2", . . . , the $G_{(2K-1)}$ pixel in the block "K", the $G_2$ pixel in the block "1", the $G_4$ pixel in the block "2", . . . , and the $G_{(2k)}$ pixel in the block "K".

In other words, the ordinal numbers $\alpha_{n1}{}^G$ to $\alpha_{n(2K)}{}^G$ of the G pixels positioned in the $n^{th}$ line are determined so that the following equations (2-1a) and (2-1b) are established:

$$\alpha_{n1}{}^G, \alpha_{n2}{}^G, \alpha_{n(2k)}{}^G \in S^G, \tag{2-1a}$$

$$\alpha_{n1}{}^G<\alpha_{n3}{}^G<\ldots<\alpha_{n(2k-1)}{}^G<\alpha_{n2}{}^G<\alpha_{n4}{}^G<\ldots<\alpha_{n(2k)}{}^G, \tag{2-1b}$$

where $\alpha_{n1}{}^G, \alpha_{n3}{}^G, \ldots$, and $\alpha_{n(2K-1)}{}^G$ are the ordinal numbers of the G pixels within the odd-numbered pixel sets and $\alpha_{n2}{}^G$, $\alpha_{n4}{}^G, \ldots$, and $\alpha_{n(2K)}{}^G$ are the ordinal numbers of the G pixels within the even-numbered pixel sets. It is apparent from FIGS. 6B and 7B that the examples shown in FIGS. 6A and 7A satisfy the requirements of the equations (2-1a) and (2-1b).

Also, the ordinal numbers of the G pixels positioned in the $(n+1)^{th}$ line is determined so as to satisfy the following requirements (Step S13):

(1) The ordinal numbers of the G pixels within the odd-numbered pixel sets of the $(n+1)^{th}$ line are selected from elements of a set $S_n{}^G{}_{even}$, and determined to be decreased in the +x direction (or increased in the −x direction), where the set $S_n{}^G{}_{even}$ is defined as a set consisting of the ordinal numbers assigned to the G pixels within the even-numbered pixel sets positioned in the $n^{th}$ line.

(2) The ordinal numbers of the G pixels within the even pixel unit along the $(n+1)^{th}$ line are selected from elements of a set $S_n{}^G{}_{odd}$, and determined as being decreased in the +x direction, where the set $S_n{}^G{}_{odd}$ is defined as a set consisting of the ordinal numbers assigned to the G pixels within the odd-numbered pixel sets positioned in the $n^{th}$ line. Accordingly, the ordinal numbers of the G pixels of the $(n+1)^{th}$ line is a reverse of those of the G pixels of the $n^{th}$ line.

In other words, the ordinal numbers $\alpha_{(n+1)1}{}^G$ to $\alpha_{(n+1)(2K)}{}^G$ of the G pixels of the $(n+1)^{th}$ line are determined so that the following equations (2-2a) and (2-2b) are established:

$$\alpha_{(n+1)1}{}^G, \alpha_{(n+1)2}{}^G, \alpha_{(n+1)(2k)}{}^G \in S^G \tag{2-2a}$$

$$\alpha_{(n+1)1}{}^G>\alpha_{(n+1)3}{}^G>\ldots>\alpha_{(n+1)(2k-1)}{}^G>\alpha_{(n+1)2}{}^G>\alpha_{(n+1)4}{}^G>\ldots>\alpha_{(n+1)(2k)}{}^G \tag{2-1b}$$

The R and B pixels are assigned with the ordinal numbers other than those assigned to the G pixels at Step S14. In the example of FIG. 6A, the R and B pixels are assigned with the ordinal numbers of 1 to 2N (also See FIG. 6B). In the example of FIG. 7A, on the other hand, the R and B pixels are assigned with the ordinal numbers of 1 to N and 2N+1 to 3N (also see FIG. 7B).

A set of the ordinal numbers of the R and B pixels determined at Step S14 is denoted $S^{RB}$. In the example of FIG. 6A, the set $S^{RB}$ is expressed by:

$$S^{RB}=\{1, 2, \ldots, 2N\}.$$

In the example of FIG. 7A, on the other hand, the set $S^{RB}$ is expressed by:

$$S^{RB}=\{1, 2, \ldots, N, 2N+1, 2N+2, \ldots, 3N\}.$$

Assuming that a set of the integers ranging from 1 to 3N is denoted by $S^{ALL}$, the set $S^{RB}$ is:

$$S^{RB}=S^{ALL}-S^G.$$

Additionally, a set $S^{RB}_L$ is defined as a set of the first half of the elements of the set $S^{RB}$, and a set $S^{RB}_u$ is defined as a set of the second half. Specifically, in the example shown in FIG. 6A, the sets $S^{RB}_L$ and $S^{RB}_U$ are expressed by:

$$S^{RB}_L=\{1, 2, \ldots, N\}, \text{ and}$$

$$S^{RB}_U=\{N+1, N+2, \ldots, 2N\}.$$

In the example shown in FIG. 7A, the sets $S^{RB}_L$ and $S^{RB}_U$ are expressed by:

$$S^{RB}_L=\{1, 2, \ldots, N\}, \text{ and}$$

$$S^{RB}_U=\{2N+1, 2N+2, \ldots, 3N\}.$$

The ordinal numbers of the R and B pixels positioned in the $n^{th}$ line are determined so as to satisfy the following requirements (a) to (c):

(a) The ordinal numbers of the R pixels are either odd or even numbers, while the ordinal numbers of the B pixels are the other numbers.

(b) The ordinal numbers of the R and B pixels within the odd numbered pixel sets are selected from the elements of the set $S^{RB}_L$ (which consists of the first half of the elements of the set $S^{RB}$), and increased in the +x direction.

(c) The ordinal numbers of the R and B pixels within the even-numbered pixel sets are selected from the elements of the set $S^{RB}_U$ (which consists of the second half of the elements of the set $S^{RB}$), and increased in the +x direction.

In other words, the ordinal numbers $\alpha_{n1}{}^{R\ to}\ \alpha_{n(2K)}{}^R$ of the R pixels positioned in the $n^{th}$ line and the ordinal numbers $\alpha_{n1}{}^B$ to $\alpha_{n(2K)}{}^B$ of the B pixels positioned in the $n^{th}$ line are determined so as to satisfy the following requirements (a) and (b):

(a) It holds:

$$\alpha_{nj}{}^R \in S^{RB}{}_{odd}, \alpha_{nj}{}^B \in S^{RB}{}_{even}, \tag{2-4a}$$

or $$\alpha_{nj}{}^R \in S^{RB}\text{even}, \alpha_{nj}{}^B \in S^{RB}\text{odd}, \tag{2-4b}$$

and (b) it holds:

$$\alpha_{n1}^{R}<\alpha_{n3}^{R}<\ldots<\alpha_{n(2k-1)}^{R}<\alpha_{n2}^{R}<\alpha_{n4}^{R}<\ldots<\alpha_{n(2k)}^{R}, \quad (2\text{-}5a)$$

$$\alpha_{n1}^{B}<\alpha_{n3}^{B}<\ldots<\alpha_{n(2k-1)}^{B}<\alpha_{n2}^{B}<\alpha_{n4}^{B}<\ldots<\alpha_{n(2k)}^{B}, \quad (2\text{-}5b)$$

where j is any integer from 1 to 2K. It is noted that the set $S^{RB}_{odd}$ is a set of the odd ordinal numbers selected out of the elements of the set $S^{RB}$ and the set $S^{RB}_{even}$ is a set of the even ordinal numbers selected out of the elements of the set $S^{RB}$.

In a simple example, the R and B pixels within the odd-numbered pixel sets positioned in the $n^{th}$ line may assigned with a set of the ordinal numbers determined to be increased along the +x direction from the minimum ordinal number assigned to the R and B pixels. In this case, the R and B pixels within the even-numbered pixel sets positioned in the $n^{th}$ line are assigned with the remaining ordinal numbers, increased along the +x direction.

The ordinal numbers of the R and B pixels positioned in the $(n+1)^{th}$ line, on the other hand, are determined so as to satisfy the following requirements (a') to (c'):

(a') The ordinal numbers of the R pixels are exchanged with the ordinal numbers of the B pixels.

(b') The ordinal numbers of the R and B pixels within the odd-numbered pixel sets are selected from the elements of the set $S^{RB}_{U}$ (which consists of the second half of the elements of the set $S^{RB}$), and decreased in the +x direction (or increased in the −x direction).

(c') The ordinal numbers of the R and B pixels within the even-numbered pixel sets are selected from the elements of the set $S^{RB}_{L}$ (which consists of the first half of the elements of the set $S^{RB}$), and increased in the +x direction.

In other words, the ordinal numbers of the R and B pixels positioned in the $(n+1)^{th}$ line are determined so as to satisfy the following requirements (a)' and (b)':

(a)' it holds:

$$\alpha_{(n+1)j}^{R}\in Sn^{B}, \quad (2\text{-}6a)$$

$$\alpha_{(n+1)j}^{B}\in Sn^{R}, \text{ and} \quad (2\text{-}6b)$$

(b)' it holds:

$$\alpha_{(n+1)1}^{R}>\alpha_{(n+1)3}^{R}>\ldots>\alpha_{(n+1)(2k-1)}^{R}>\alpha_{(n+1)2}^{R}>\alpha_{(n+1)4}^{R}>\ldots>\alpha_{(n+1)(2K)}^{R}, \text{ and} \quad (2\text{-}7a)$$

$$\alpha_{(n+1)1}^{B}>\alpha_{(n+1)3}^{B}>\ldots>\alpha_{(n+1)(2k-1)}^{B}>\alpha_{(n+1)2}^{B}>\alpha_{(n+1)4}^{B}>\ldots>\alpha_{(n+1)(2K)}^{B}, \quad (2\text{-}7b)$$

where j is any number from 1 to 2K. It is noted that $S_n^{R}$ is a set of the ordinal numbers $\alpha_{n1}^{R}$ to $\alpha_{n(2K)}^{R}$ of the R pixels positioned in the $n^{th}$ line, while $S_n^{B}$ is a set of the ordinal numbers $\alpha_{n1}^{B}$ to $\alpha_{n(2K)}^{B}$ of the B pixels positioned in the $n^{th}$ line.

In a simple example, the R and B pixels within the odd-numbered pixel sets positioned in the $(n+1)^{th}$ line are assigned with the ordinal numbers determined to be decreased along the +x direction from the maximum ordinal number assigned to the R and B pixels. Also, the R and B pixels within the even-numbered pixel sets positioned in the $(n+1)^{th}$ line are assigned with the remaining ordinal numbers, decreased along the +x direction.

As the ordinal numbers of the pixels positioned in the $n^{th}$ and (n+1) lines are determined in this manner, the requirements described in the first embodiment can be satisfied. More particularly, the ordinal numbers of the pixels positioned in the $n^{th}$ and $(n+1)^{th}$ lines are primarily determined so as to satisfy the following requirements:

(a) $\alpha_{nj}^{\gamma}\neq\alpha_{(n+1)j}^{\gamma}$, for j being any integer from 1 to 2K, and γ being any of "R", "G", and "B", and (b) the sums of the ordinal numbers of the R and B pixels positioned in the same columns over the $n^{th}$ line and the $(n+1)^{th}$ line are constant; in other words, it holds:

$$\begin{aligned}\alpha_{n1}^{R}+\alpha_{(n+1)1}^{R}&=\alpha_{n1}^{B}+\alpha_{(n+1)1}^{B}\\&=\alpha_{n1}^{B}+\alpha_{(n+1)1}^{B}\\&=\alpha_{n2}^{R}+\alpha_{(n+1)2}^{R}\\&=\alpha_{n2}^{B}+\alpha_{(n+1)2}^{B}\\&\ldots\\&=\alpha_{n(2K)}^{R}+\alpha_{(n+1)(2K)}^{R}\\&=\alpha_{n(2K)}^{B}+\alpha_{(n+1)(2K)}^{B}\\&=K^{L}.\end{aligned}$$

This effectively achieves even distribution of the pixels experiencing increased changes in the drive voltages, thus improving the uniformity of brightness throughout the image.

3. For the Case when Line Cycle is 2N(=4K) Lines

Figure 9B:
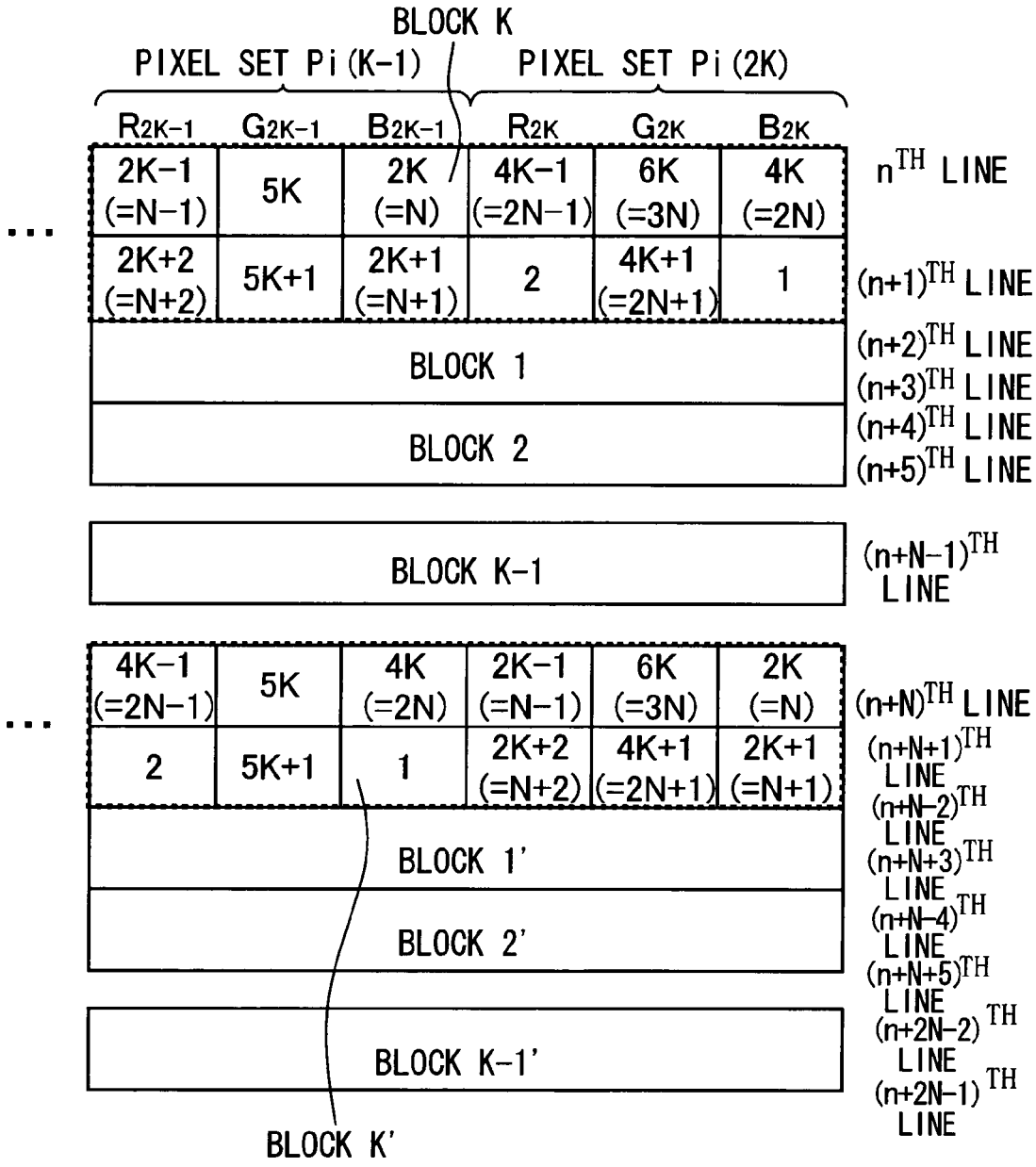

FIGS. 9A and 9B illustrate an example of the drive sequence of each line where the line cycle is 2N lines. The drive sequence of each line is definitely varied between the $n^{th}$ to $(n+N-1)^{th}$ lines at a first half and the $(n+N)^{th}$ to $(n+2N-1)^{th}$ lines at the second half.

(1) Drive Sequences of $n^{th}$ to $(n+N-1)^{th}$ Lines

Figure 10:
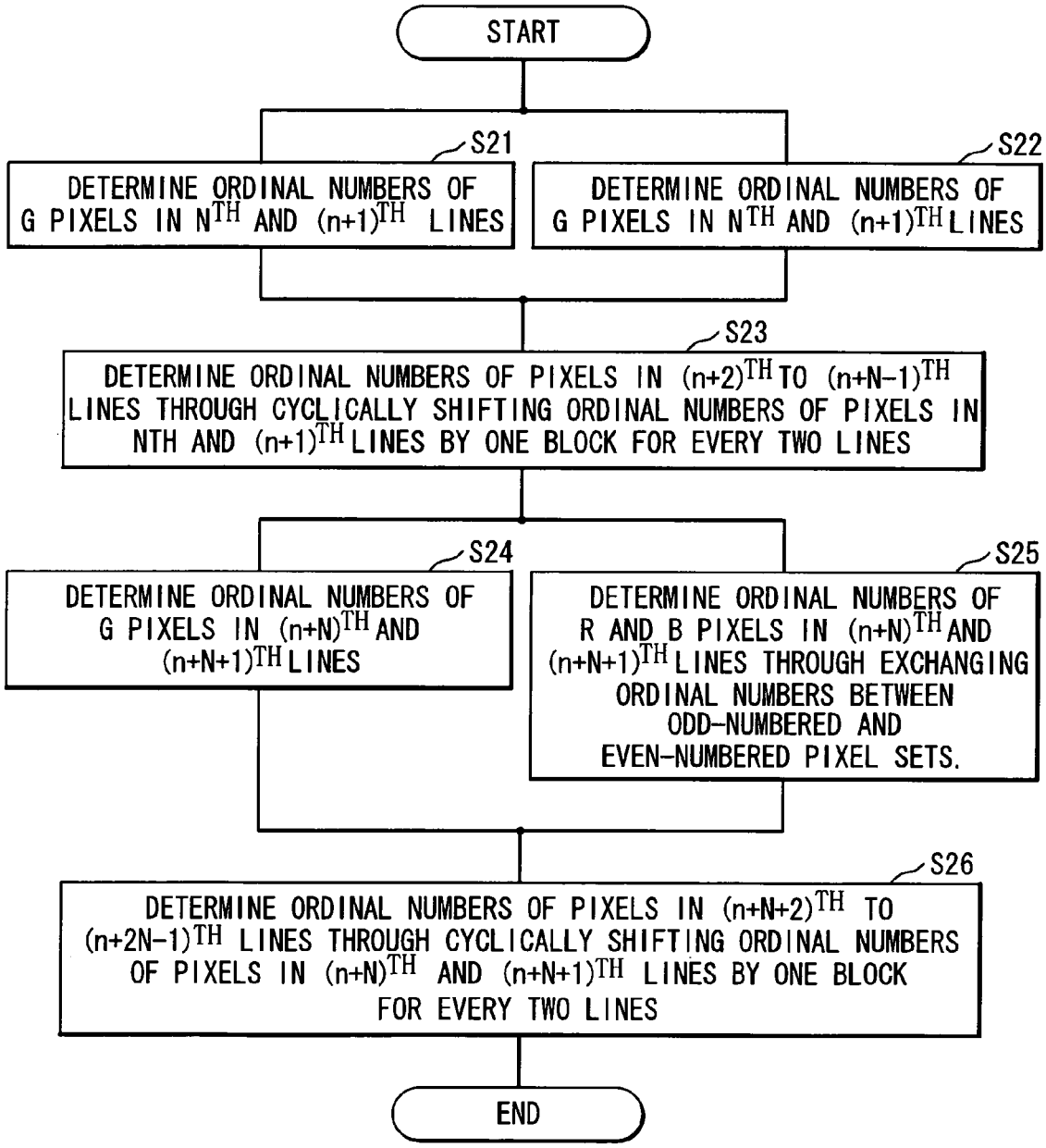
FIG. 10 is a flowchart showing an algorithm for determining the drive sequence of each line in the second embodiment for the case when the line cycle is 2N lines.

As shown in FIG. 10, the drive sequences of the first two lines of the $n^{th}$ to $(n+N-1)^{th}$ lines (that is, the $n^{th}$ and $(n+1)^{th}$ lines) are determined at Steps S21 and S22 as being identical to those described above for the case when the line cycle is two lines. The example shown in FIGS. 9A and 9B illustrates the drive sequences of the $n^{th}$ and $(n+1)^{th}$ lines identical to those shown in FIG. 6A. The drive sequences of the $n^{th}$ and $(n+1)^{th}$ lines may be identical to those shown in FIG. 7A.

Also as shown in FIG. 10, the drive sequences of the $(n+2)^{th}$ to $(n+N-1)^{th}$ lines are determined by cyclically shifting the drive sequences of the $n^{th}$ and $(n+1)^{th}$ lines by one block for every two lines (or two pixel sets for every two lines) at Step S23. More specifically, as shown in FIGS. 9A and 9B, the drive sequences of the $(n+2p)^{th}$ and $(n+2p+1)^{th}$ lines are equal to the drive sequences of the $(n+2p-2)^{th}$ and $(n+2p-1)^{th}$ lines cyclically shifted by one block in the +x (or −x) direction, where p is an integer from 1 to K−1.

In other words, the ordinal numbers of the pixels positioned in the $(n+2)^{th}$ to $(n+N-1)^{th}$ lines may be cyclically shifted along the +x direction, and determined so as to satisfy the following equations (2-8a to 2-8f):

$$\alpha_{(n+2p)1}^{\gamma}=\alpha_{(n+2p-2)(2K-1)}^{\gamma} \quad (2\text{-}8a)$$

$$\alpha_{(n+2p)2}^{\gamma}=\alpha_{(n+2p-2)(2K)}^{\gamma} \quad (2\text{-}8b)$$

$$\alpha_{(n+2p)j}^{\gamma}=\alpha_{(n+2p-2)(j-2)}^{\gamma} \quad (2\text{-}8c)$$

and $$\alpha_{(n+2p+1)1}^{\gamma}=\alpha_{(n+2p-1)(2K-1)}^{\gamma}, \quad (2\text{-}8d)$$

$$\alpha_{(n+2p+1)2}^{\gamma}=\alpha_{(n+2p-1)(2K)}^{\gamma}, \quad (2\text{-}8e)$$

$$\alpha_{(n+2p+1)j}^{\gamma}=\alpha_{(n+2p-1)(j-2)}^{\gamma}, \quad (2\text{-}8f)$$

where p is any integer from 1 to K−1, j is any integer from 3 to 2K, and γ is any of "R", "G", and "B" pixels.

Alternatively, the ordinal numbers of the pixels positioned in the $(n+2)^{th}$ to $(n+N-1)^{th}$ lines may be cyclically shifted along the −x direction, and determined so as to satisfy the following equations (2-9a to 2-9f):

$$\alpha_{(n+2p)j}^{\gamma}=\alpha_{(n+2p-2)(j+2)}^{\gamma}, \quad (2\text{-}9a)$$

$$\alpha_{(n+2p)(2K-1)}^{65}=\alpha_{(n+2p-2)1}^{\gamma}, \quad (2\text{-}9b)$$

$$\alpha_{(n+2p)2K}^{65}=\alpha_{(n+2p-2)2}^{\gamma}, \quad (2\text{-}9c)$$

$$\alpha_{(n+2p+1)j}^{\gamma}=\alpha_{(n+2p-1)(j+2)}^{\gamma}, \quad (2\text{-}9d)$$

$$\alpha_{(n+2p+1)(2K-1)}^{\gamma}=\alpha_{(n+2p-1)1}^{\gamma}, \quad (2\text{-}9e)$$

$$\alpha_{(n+2p)2K}^{\gamma}=\alpha_{(n+2p-1)2}^{\gamma}, \quad (2\text{-}9f)$$

where p is any integer from 1 to K−1, j is any integer from 1 to 2K−2, and γ is any of "R", "G", and "B".

(2) Drive Sequence of $(n+N)^{th}$ to $(n+2N-1)^{th}$ Lines

A method of determining the drive sequences of the pixels of the first two lines (that is, the $(n+N)^{th}$ and $(n+N+1)^{th}$ lines) will now be firstly described.

As shown in FIG. 10, the ordinal numbers of the G pixels positioned in the $(n+N)^{th}$ and $(n+N+1)^{th}$ lines are determined as being identical to those of the G pixels of the $n^{th}$ and $(n+1)^{th}$ lines at Step S24. More particularly, as shown in FIGS. 9A and 9B, the ordinal numbers of the G pixels are given by the following equations (2-10a and 2-10b):

$$\alpha_{(n+N)j}^{G}=\alpha_{nj}^{G}, \text{ and} \quad (2\text{-}10a)$$

$$\alpha_{(n+N+1)j}^{G}=\alpha_{(n+1)j}^{G}, \quad (2\text{-}10b)$$

where j is any integer ranging from 1 to 2K.

Also as shown in FIG. 10, the ordinal numbers of the R and B pixels positioned in the $(n+N)^{th}$ and $(n+N+1)^{th}$ lines are determined at Step S25 by exchanging the ordinal numbers of the R and B pixels positioned in the $n^{th}$ and $(n+1)^{th}$ lines between the odd-numbered pixel sets and the corresponding even-numbered pixel sets within the same block. More specifically, as shown in FIGS. 9A and 9B, the ordinal numbers $\alpha_{(n+N+1)j}^{R}$ and $\alpha_{(n+N+1)j}^{B}$ of the R and B pixels positioned in the $(n+N+1)^{th}$ line, and the ordinal numbers $\alpha_{(n+N+2)j}^{R}$ and $\alpha_{(n+N+2)j}^{B}$ of the R and B pixels positioned in the $(n+N+2)^{th}$ line are expressed by:

$$\alpha_{(n+N)(2q-1)}^{R}=\alpha_{n(2q)}^{R}, \quad (2\text{-}11a)$$

$$\alpha_{(n+N)(2q)}^{R}=\alpha_{n(2q-1)}^{R}, \quad (2\text{-}11b)$$

$$\alpha_{(n+N)(2q-1)}^{B}=\alpha_{n(2q)}^{B}, \quad (2\text{-}11c)$$

$$\alpha_{(n+N)(2q)}^{B}=\alpha_{n(2q-1)}^{B}, \quad (2\text{-}11d)$$

$$\alpha_{(n+N+1)(2q-1)}^{R}=\alpha_{(n+1)(2q)}^{R}, \quad (2\text{-}12a)$$

$$\alpha_{(n+N+1)(2q)}^{R}=\alpha_{(n+1)(2q-1)}^{R}, \quad (2\text{-}12b)$$

$$\alpha_{(n+N+1)(2q-1)}^{B}=\alpha_{(n+1)(2q)}^{B}, \text{ and} \quad (2\text{-}12c)$$

$$\alpha_{(n+N+1)(2q)}^{R}=\alpha_{(n+1)(2q-1)}^{R}, \quad (2\text{-}12d)$$

where q is any integer ranging from 1 to K.

In FIGS. 9A and 9B, a block "j" designates a block composed of the pixel sets $P_{(n+N)(2j-1)}$ and $P_{(n+N)(2j)}$ positioned in the $(n+N)^{th}$ line, and the pixel sets $P_{(n+N+1)(2j-1)}$ and $P_{(n+N+1)(2j)}$ positioned in the $(n+N+1)^{th}$ line. For example, the block "1'" is composed of the pixel sets $P_{(n+N)1}$ and $P_{(n+N)1}$ positioned in the $(n+N)^{th}$ line and the pixel sets $P_{(n+N+1)1}$ and $P_{(n+N+1)2}$ positioned in the $(n+N+1)^{th}$ line.

As shown in FIG. 10, the drive sequences of the remaining lines (that is, the $(n+N+2)^{th}$ to $(n+2N-1)^{th}$ lines) are determined at Step S23 by cyclically shifting the drive sequences of the $(n+N)^{th}$ to $(n+N+1)^{th}$ lines by one block for every two lines. More particularly, as shown in FIGS. 9A and 9B, the ordinal numbers of the pixels positioned in the $(n+N+2p)^{th}$ and $(n+2N+2p+1)^{th}$ lines are equal to those of the pixels positioned in the $(n+N+2p-2)^{th}$ and $(n+N+2p-1)^{th}$ lines cyclically shifted in the +x (or −x) direction, where p is any integer ranging from 1 to K−1.

(3) Examples

FIG. 9C illustrates an example of the drive sequence of each line with K being two (that is, with N being four) for the case when the line period is eight (=2N) lines. The drive sequences of the $n^{th}$ and $(n+1)^{th}$ lines are identical to those shown in FIG. 6C.

The drive sequences of the $(n+2)^{th}$ and $(n+3)^{th}$ lines are determined by cyclically shifting the ordinal numbers of the pixels positioned in the $n^{th}$ and $(n+1)^{th}$ lines by one block in the x (or −x) direction. As K is two, the cyclic shifting in the +x direction is equivalent to the cyclic shifting in the −x direction.

Also, the drive sequences of the $(n+4)^{th}$ (=$(n+N)^{th}$) and $(n+5)^{th}$ lines are determined by exchanging the ordinal numbers of the pixels positioned in the $n^{th}$ and $(n+1)^{th}$ lines between the odd-numbered pixel set $P_{i1}$ and the corresponding even-numbered pixel set $P_{i2}$, and also exchanging between the odd-numbered pixel set $P_{i3}$ and the corresponding even-numbered pixel set $P_{i4}$.

The drive sequences of the $(n+6)^{th}$ and $(n+7)^{th}$ lines are determined by cyclically shifting the ordinal numbers of the pixels positioned in the $(n+4)^{th}$ and $(n+5)^{th}$ lines by one block in the x (or −x) direction.

(4) Brief Conclusion

As the drive sequence of each line is determined in that manner, (a) the ordinal numbers of the pixels in each column are determined to be different from one another over each line cycle, and (b) the sums of the ordinal numbers of the R and B pixels in the same columns over each line cycle are constant. More particularly, the drive sequences are determined so as to satisfy the following equation:

$$\sum_{i=n}^{n+3}\alpha_{i1}^{R}=\sum_{i=n}^{n+3}\alpha_{i1}^{B}=\sum_{i=n}^{n+3}\alpha_{i2}^{R}=\sum_{i=n}^{n+3}\alpha_{i2}^{B}=\ldots$$
$$=\sum_{i=n}^{n+3}\alpha_{i(2N)}^{R}=\sum_{i=n}^{n+3}\alpha_{i(2N)}^{B}=K'_{L},$$

This allows the pixels experiencing increased changes in the drive voltages thereacross to be spatially scattered uniformly, hence effectively eliminating the generation of uneven brightness.

4. Frame Rate Control

A frame rate control technique is also applicable to the second embodiment. Referring to FIG. 11, for the case when the line cycle is two lines, a frame rate control is achieved through clockwisely (or counter-clockwisely) rotating the 2×2K elements of the partial drive sequence matrix associated with the $n^{th}$ and $(n+1)^{th}$ lines for each of the R, G, and B pixels. The frame rate control period where the drive sequences are temporally cycled is 2N (=4K) frames. FIG. 11 illustrates the case with K being two.

For the case shown in FIG. 11, for example, the partial drive sequence matrix of the R pixels associated with the $n^{th}$ and $(n+1)^{th}$ lines for the $k^{th}$ frame is expressed by:

$$X^R_{n,n+1}{}^k = \begin{pmatrix} 1 & 5 & 3 & 7 \\ 8 & 4 & 6 & 2 \end{pmatrix}, \tag{2-14}$$

Also, the partial drive sequence matrix of the R pixels associated with the $n^{th}$ and $(n+1)^{th}$ lines for the $(k+1)^{th}$ frame is:

$$X^R_{n,n+1}{}^{k+1} = \begin{pmatrix} 8 & 1 & 5 & 3 \\ 4 & 6 & 2 & 7 \end{pmatrix}, \tag{2-15}$$

This matrix is obtained through clockwisely rotating the eight (=2N) elements of the partial drive sequence matrix of the R pixels for the $k^{th}$ frame. The same goes for the $(k+2)^{th}$ to $(k+7)^{th}$ flames, and also goes for the drive sequences of the G and B pixels. The eight elements of the partial drive sequence matrix may be rotated counter-clockwisely with equal success.

For the case when the line cycle is 2N lines, a frame rate control is achieved through clockwisely (or counter-clockwisely) rotating the 2×2K elements of the partial drive sequence matrix of every two lines at every frame, for each of the R, G, and B pixels. More specifically, the drive sequences of the $n^{th}$ and $(n+1)^{th}$ lines during each frame are determined by clockwisely (or counter-clockwisely) rotating the 2×2K elements of the partial drive sequence matrix associated with the $n^{th}$ and $(n+1)^{th}$ lines at every frame, for each of the R, G, and B pixels. Correspondingly, the drive sequences of the $(n+2p)^{th}$ and $(n+2p+1)^{th}$ lines during each frame are determined by rotating the 2×2K elements of the partial drive sequence matrix associated with the $(n+2p)^{th}$ and $(n+2p+1)^{th}$ lines, for each of the R, G, and B pixels at every frame.

Specifically, in the example shown in FIG. 12, the partial drive sequence partial matrix $X^R_{n,n+1}{}^k$ of the R pixels associated with the $n^{th}$ and $(n+1)^{th}$ lines for the $k^{th}$ frame is expressed by the above-described equation (2-14), while the partial drive sequence matrix $X^R_{n,n+1}{}^{k+1}$ of the R pixels associated with the $n^{th}$ and $(n+1)^{th}$ lines for the $(k+1)^{th}$ frame is expressed by the above-described equation (2-15). As clearly apparent from the two equations (2-14) and (2-15), the partial drive sequence matrix $X^R_{n,n+1}{}^{k+1}$ of the R pixels associated with the $n^{th}$ and $(n+1)^{th}$ lines for the $(k+1)^{th}$ frame is obtained by clockwisely rotating the eight (=2N) elements of the partial drive sequence matrix $X^R_{n,n+1}{}^k$ for the $k^{th}$ frame. The partial drive sequence partial matrix for each of the $(k+_2)^{th}$ to $(k+7)^{th}$ frames is also obtained in the same way. This is also the case for the G and B pixels.

Correspondingly, the partial drive sequence matrix $X^R_{n+2,n+3}{}^k$ of the R pixels associated with he $(n+2)^{th}$ and $(n+3)^{th}$ lines for the $k^{th}$ frame, and the partial drive sequence matrix $X^R_{n+2,n+3}{}^{(k+1)}$ of the R pixels for the $(k+1)^{th}$ frame are expressed by the following equations (2-16) and (2-17):

$$X^R_{n+2,n+3}{}^k = \begin{pmatrix} 3 & 7 & 1 & 5 \\ 6 & 2 & 8 & 4 \end{pmatrix}, \tag{2-16}$$

$$X^R_{n+2,n+3}{}^{k+1} = \begin{pmatrix} 6 & 3 & 7 & 1 \\ 2 & 8 & 4 & 5 \end{pmatrix}, \tag{2-17}$$

As apparent from the equations (2-16) and (2-17), the partial drive sequence matrix $X^R_{n+2,n+3}{}^{k+1}$ of the R pixels for the $(k+1)^{th}$ frame is obtained through clockwisely rotating the eight (=2N) elements of the partial drive sequence matrix $X^R_{n+2,n+3}{}^k$ of the R pixels for the $k^{th}$ frame.

The same goes for the remaining lines, that is, the $(n+4)^{th}$ to $(n+7)^{th}$ lines.

The above-described frame rate control allows the drive sequences during each frame period to be determined so that the sum of the ordinal numbers of each pixel is constant over each frame rate control period (from the $k^{th}$ frame to the $(k+2N)^{th}$ frame).

THIRD EMBODIMENT

1. Structure of Display Device

Figure 13:
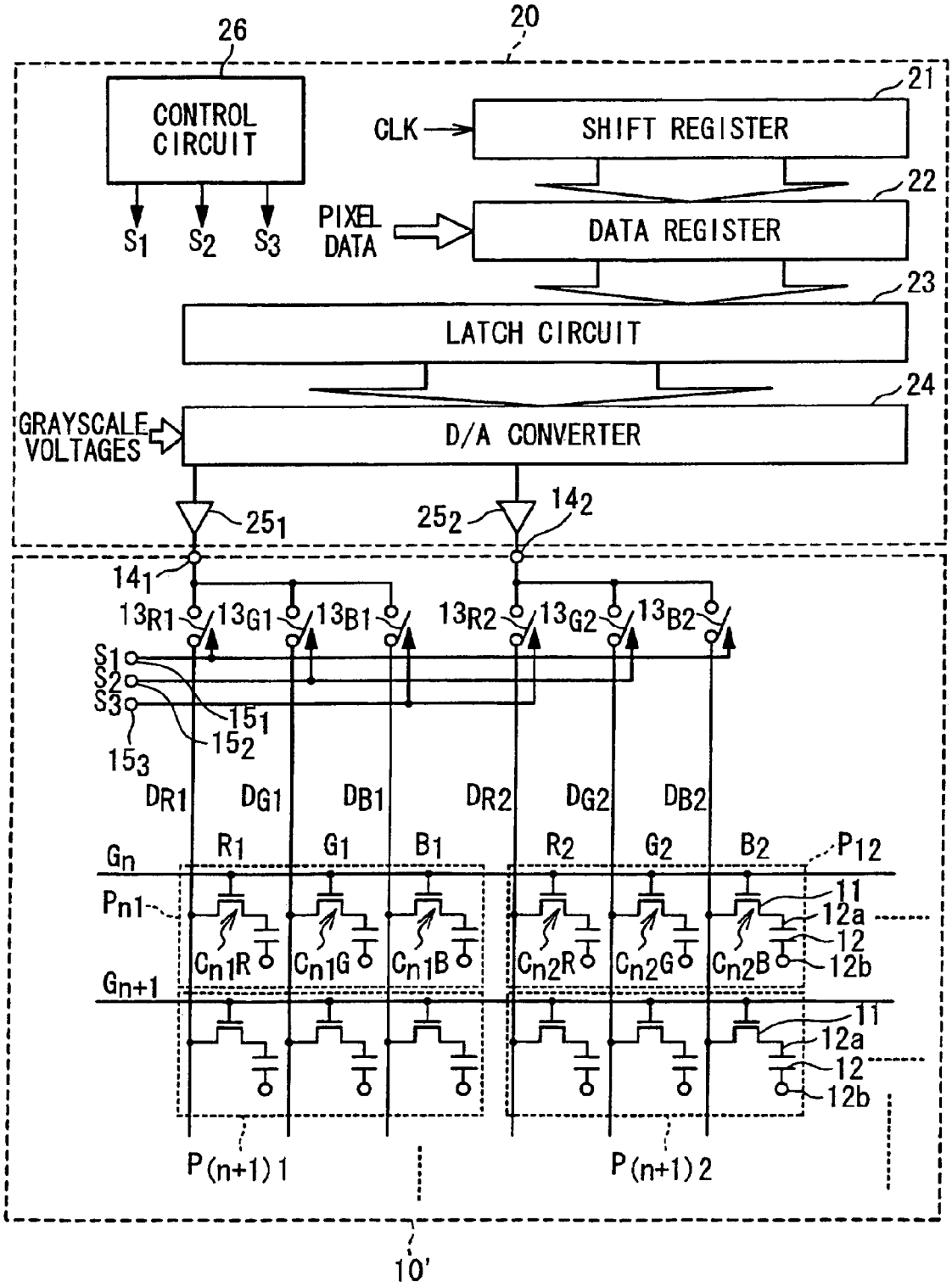
FIG. 13 is a block diagram showing an arrangement of a display device where the display panel driving method of a third embodiment of the present invention is implemented.

A third embodiment of the present invention will be described in conjunction with a display device, shown in FIG. 13, where three signal lines are time-divisionally driven by the foregoing display panel driving method. In this embodiment, a liquid crystal display panel 10' is differentiated from the display panel 10 shown in FIG. 2 by the fact that the pixels within the pixel set $P_{i1}$ are connected to a different input terminals 14 from that connected with the pixels within the pixel unit $P_{i2}$. It is hence assumed that the input terminal connected with the pixel unit $P_{i1}$ is denoted by $\mathbf{14}_1$, while the input terminal connected with the pixel unit $P_{i2}$ is denoted by $\mathbf{14}_2$. Also, an amplifier connected to the input terminal $\mathbf{14}_1$ is denoted by $\mathbf{25}_1$, while another amplifier connected to the input terminal $\mathbf{14}_2$ is denoted by $\mathbf{25}_2$. More particularly, the R pixel $C_{i1}{}^R$, the G pixel $C_{i1}{}^G$, and the B pixel $C_{i1}{}^B$ within the pixel set $P_{i1}$, are connected through three switches $\mathbf{13}_{R1}$, $\mathbf{13}_{G1}$, and $\mathbf{13}_{B1}$ respectively to the input terminal $\mathbf{14}_1$. The R pixel $C_{i2}{}^R$, the G pixel $C_{i2}{}^G$, and the B pixel $C_{i2}{}^B$ in the pixel set $P_{i2}$ are connected through three switches $\mathbf{13}_{R2}$, $\mathbf{13}_{G2}$, and $\mathbf{13}_{B2}$, respectively, to the input terminal $\mathbf{14}_2$.

In the third embodiment, a set of three control signals are provided for the liquid crystal panel 10'. The liquid crystal display panel 10' includes three terminals $\mathbf{15}_1$ to $\mathbf{15}_3$ for receiving the control signals $S_1$ to $S_3$, respectively. The terminal $\mathbf{15}_1$, is connected to the switches $\mathbf{13}_{R1}$ and $\mathbf{13}_{B2}$. The terminal $\mathbf{15}_2$ is connected to the switches $\mathbf{13}_{G1}$ and $\mathbf{13}_{G2}$. The terminal $\mathbf{15}_3$ is connected to the switches $\mathbf{13}_{B1}$ and $\mathbf{13}_{R2}$.

Differently from the display device shown in FIG. 1, the control signals received by the switches $\mathbf{13}_{R2}$, $\mathbf{13}_{G2}$, and $\mathbf{13}_{B2}$ are different or opposite in the sequence to those received by the switches $\mathbf{13}_{R1}$, $\mathbf{13}_{G1}$, and $\mathbf{13}_{B1}$, respectively. The switches $\mathbf{13}_{R2}$, $\mathbf{13}_{G2}$, and $\mathbf{13}_{B2}$, connected to the $R_2$, $G_2$, and $B_2$ pixels associated therewith, respectively, receive the control signals $S_3$, $S_2$, and $S_1$, respectively. More specifically, the switch $\mathbf{13}_{R2}$, connected to the $R_2$ pixels, is supplied with the control signal which is also received by the switch $\mathbf{13}_{B1}$, connected to the $B_1$ pixels; this results in that the switch $\mathbf{13}_{R2}$ is turned on together with the switch $\mathbf{13}_{B1}$. Correspondingly, the switch $\mathbf{13}_{B2}$, connected to the $B_2$ pixels, is supplied with the control signal which is also received by the switch $\mathbf{13}_{R1}$, connected to the $R_1$ pixels; this results in that the switch $\mathbf{13}_{B2}$ is turned on together with the switch $\mathbf{13}_{R1}$. As will be described later in more detail, the sequence of the control signals received by the switches $\mathbf{13}_{R2}$, $\mathbf{13}_{G2}$, and $\mathbf{13}_{B2}$ is a reverse of the sequence of the control signals received by the switches $\mathbf{13}_{R1}$, $\mathbf{13}_{G1}$, and $\mathbf{13}_{B1}$. This is essential for eliminating the uneven brightness.

2. Display Panel Drive Method in the Third Embodiment

Similarly to the display panel driving method of the first embodiment, as shown in FIG. 14, the display panel driving method of the third embodiment is contemplated for varying the drive sequences between any two adjacent lines, and thereby reducing the generation of vertical segments of uneven brightness resulting from changes in the drive voltages across the pixels. For reducing uneven brightness, the ordinal numbers of the $R_1$, $B_1$, $R_2$, and $B_2$ pixels positioned in a specific line are determined as being deferent from the corresponding pixels positioned in the adjacent line.

An additional requirement of the display panel driving method of this embodiment is that the G pixel within each pixel set is assigned with the ordinal number of "3". As the G pixels are most easily perceived by human vision, the G pixels are finally driven during the drive sequence, thus eliminating the vertical segments of uneven brightness on the liquid crystal panel 10'.

Additionally, in the display panel driving method of this embodiment, the drive sequence of the pixel set $P_{i1}$ positioned in the $i^{th}$ line is different from that of the pixel set $P_{i2}$ positioned horizontally adjacent in the same line. This is implemented by providing the control signals for the switches $\mathbf{13}_{R2}$, $\mathbf{13}_{G2}$, and $\mathbf{13}_{B2}$ in an opposite order of providing the control signals for the switches $\mathbf{13}_{R1}$, $\mathbf{13}_{G1}$, and $\mathbf{13}_{B1}$. As the pixel set $P_{i1}$, positioned in the $i^{th}$ line is different in the drive sequence from the adjacent pixel set $P_{i2}$, the pixels experiencing increased changes in the drive voltages thereacross are effectively spatially scattered. This effectively reduces vertical or horizontal segments of uneven brightness.

Figure 15:
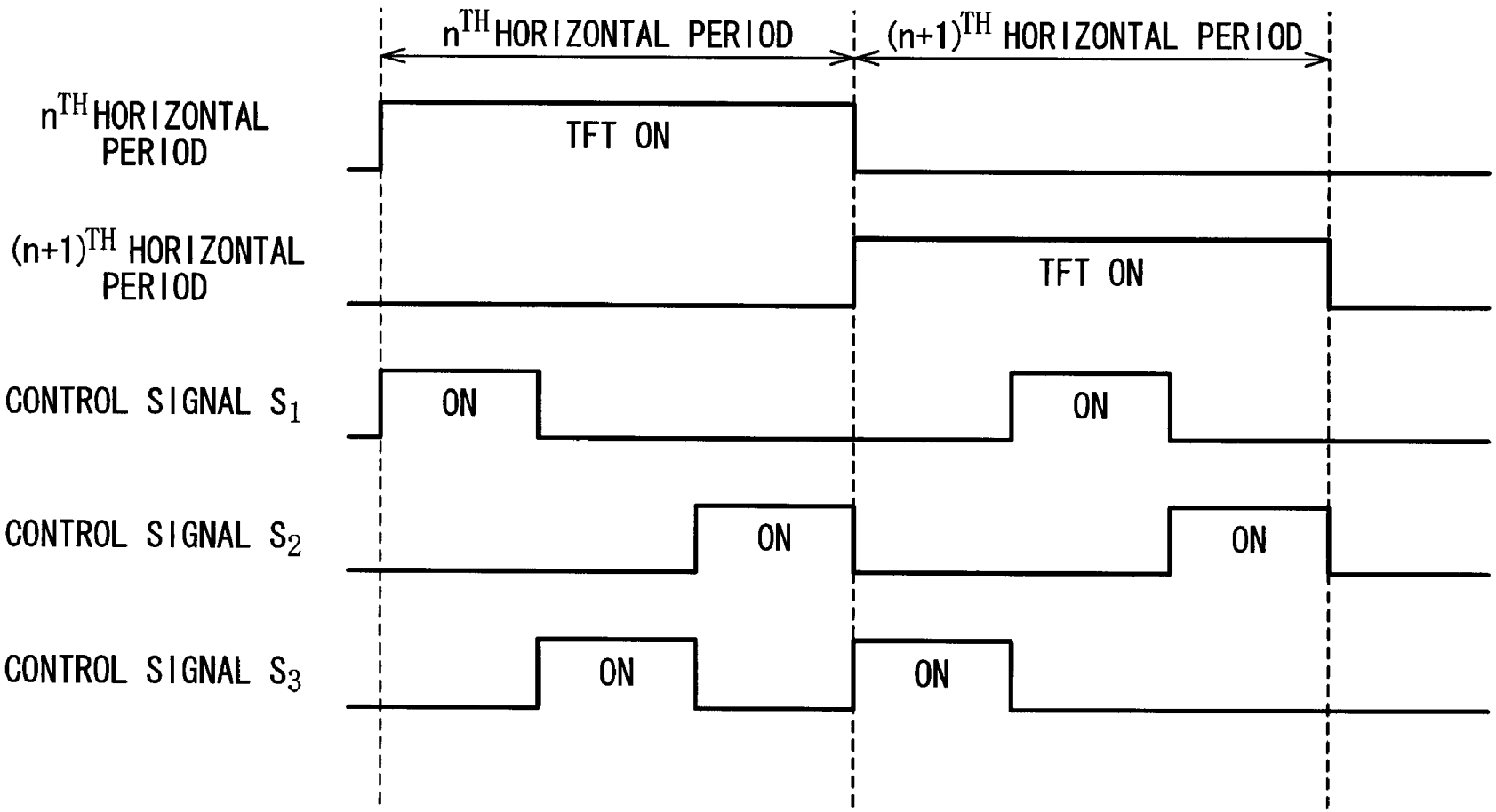
FIG. 15 is a timing chart showing the waveforms of signals to be supplied to the liquid crystal display panel according to the display panel driving method of the third embodiment.

FIG. 15 is a timing chart showing the waveforms of signals supplied to the liquid crystal panel 10' in the display panel driving method of this embodiment.

The drive of the pixels positioned in the $n^{th}$ line starts with activating the $n^{th}$ scanning line $G_n$ at the $n^{th}$ horizontal period. This allows the TFTs 11 within the pixels along the $n^{th}$ line to be turned on for providing accesses to the liquid crystal capacitors 12.

This is followed by activating the control signal $S_1$, to select the signals lines $D_{R1}$ and $D_{B2}$. In other words, the switches $\mathbf{13}_{R1}$ and $\mathbf{13}_{B2}$ are turned on while the remaining switches are turned off. As timed with the activation of the control signal $S_1$, the drive voltage for the $R_1$ pixel $C_{n1}{}^{R}$ is transmitted from the amplifier $\mathbf{25}_1$, to the input terminal $\mathbf{14}_1$, and the drive voltage for the $B_2$ pixel $C_{n2}{}^{B}$ is transmitted from the amplifier $\mathbf{25}_2$ to the input terminal $\mathbf{14}_2$. As a result, the $R_1$ pixel $C_{n1}{}^{R}$ receives the drive voltage from the signal line $D_{R1}$, and simultaneously, the $B_2$ pixel $C_{n2}{}^{B}$ receives the drive voltage from the signal line $D_{B2}$.

Then, the control signal $S_3$ is activated to turn on the switches $\mathbf{13}_{B1}$ and $\mathbf{13}_{R2}$. As timed with the activation of the control signal $S_3$, the drive voltage for the $B_1$ pixel $C_{n1}{}^{B}$ is transmitted from the amplifier $\mathbf{25}_1$, to the input terminal $\mathbf{14}_1$, and the drive voltage for the $R_2$ pixel $C_{n2}{}^{R}$ is transmitted from the amplifier $\mathbf{25}_2$ to the input terminal $\mathbf{14}_2$. As a result, both the $B_1$ pixel $C_{n1}{}^{B}$ and the $R_2$ pixel $C_{n2}{}^{R}$ are driven with the associated drive voltages.

Finally, the control signal $S_2$ is activated to turn on the switches $\mathbf{13}_{G1}$ and $\mathbf{13}_{G2}$. As timed with the activation of the control signal $S_2$, the drive voltage for the $G_1$ pixel $C_{n1}{}^{G}$ is transmitted from the amplifier 251 to the input terminal $\mathbf{14}_1$, and the drive voltage for the $G_2$ pixel $C_{n2}{}^{G}$ is transmitted from the amplifier $\mathbf{25}_2$ to the input terminal $\mathbf{14}_2$. As a result, both the $G_1$ and $G_2$ pixels $C_{n1}{}^{G}$ and $C_{n2}{}^{G}$ are driven with the associated drive voltages.

Accordingly, as shown in FIG. 14, the pixels within the pixel sets $P_{n1}$ and $P_{n2}$ are driven in different sequences. More particularly, the pixels within the pixel set $P_{n1}$ positioned in the $n^{th}$ line are driven in this order of the $R_1$, $B_1$, and $G_1$ pixels, while the pixels within the pixel set $P_{n2}$ are driven in this order of the $B_2$, $R_2$, and $G_2$ pixels. In addition, the $G_1$ and $G_2$ pixels in both the pixel sets $P_{n1}$ and $P_{n2}$ are finally driven at the last stage of the drive sequence. This effectively eliminates the vertical segments of uneven brightness.

After the completion of the drive of the pixels positioned in the $n^{th}$ line, the pixels positioned in the $(n+1)^{th}$ line are then driven, as shown in FIG. 15. After the $(n+1)^{th}$ scanning line $G_{n+1}$ is activated in the $(n+1)^{th}$ horizontal period, the control signals $S_1$-$S_3$ are sequentially activated. For the $(n+1)^{th}$ line, the control signals $S_1$ to $S_3$ are activated in a different order from that for the $n^{th}$ line. More specifically, the control signals $S_3$, $S_1$, and $S_2$ are activated in this order. The order of providing the drive voltages for the associated pixels positioned in the $(n+1)^{th}$ line is appropriately determined in accordance with the order of activating the control signals $S_1$ to $S_3$.

As a result, the ordinal numbers of the $R_1$, $B_1$, $R_2$, and $B_2$ pixels are different between the $n^{th}$ line and the $(n+1)^{th}$ line as shown in FIG. 14. This effectively reduces the generation of uneven brightness.

Figure 16:
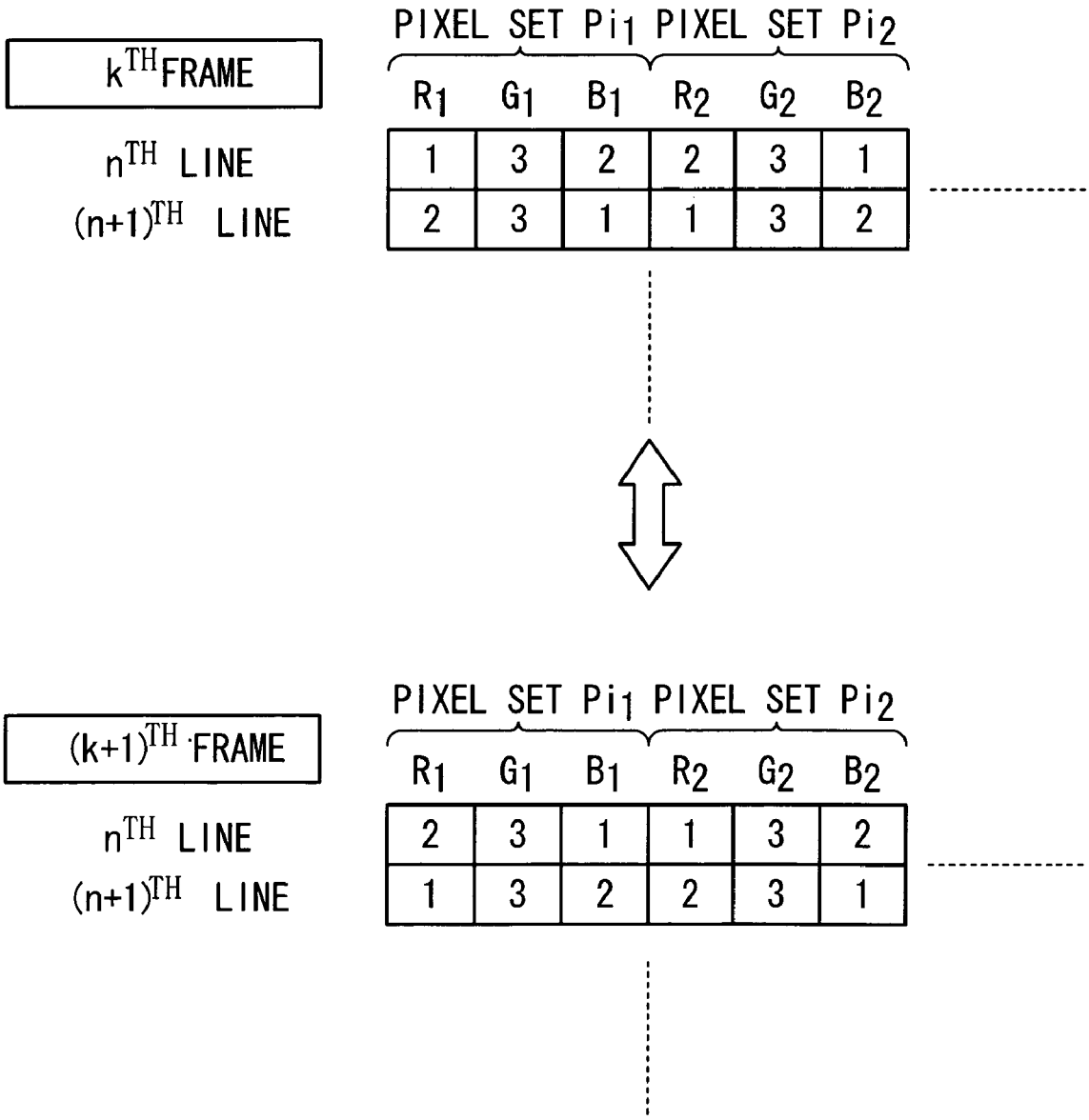
FIG. 16 illustrates an example of the drive sequence of each line for each frame according to the third embodiment for the case when a frame rate control technique is employed.

For further eliminating the generation of uneven brightness, a frame rate control technique (FRC) may be employed as shown in FIG. 16 so that the drive sequence of each line is switched at every frame. The frame rate control allows the pixels experiencing increased changes in the drive voltages thereacross to be temporally distributed, thus further reducing the generation of vertical and horizontal segments of uneven brightness. In an example shown in FIG. 16, the drive sequences of the pixel set $P_{n1}$ positioned in the $n^{th}$ line are different between the $k^{th}$ frame and the $(k+1)^{th}$ frame. The same goes for other pixel sets.

Figure 17A:
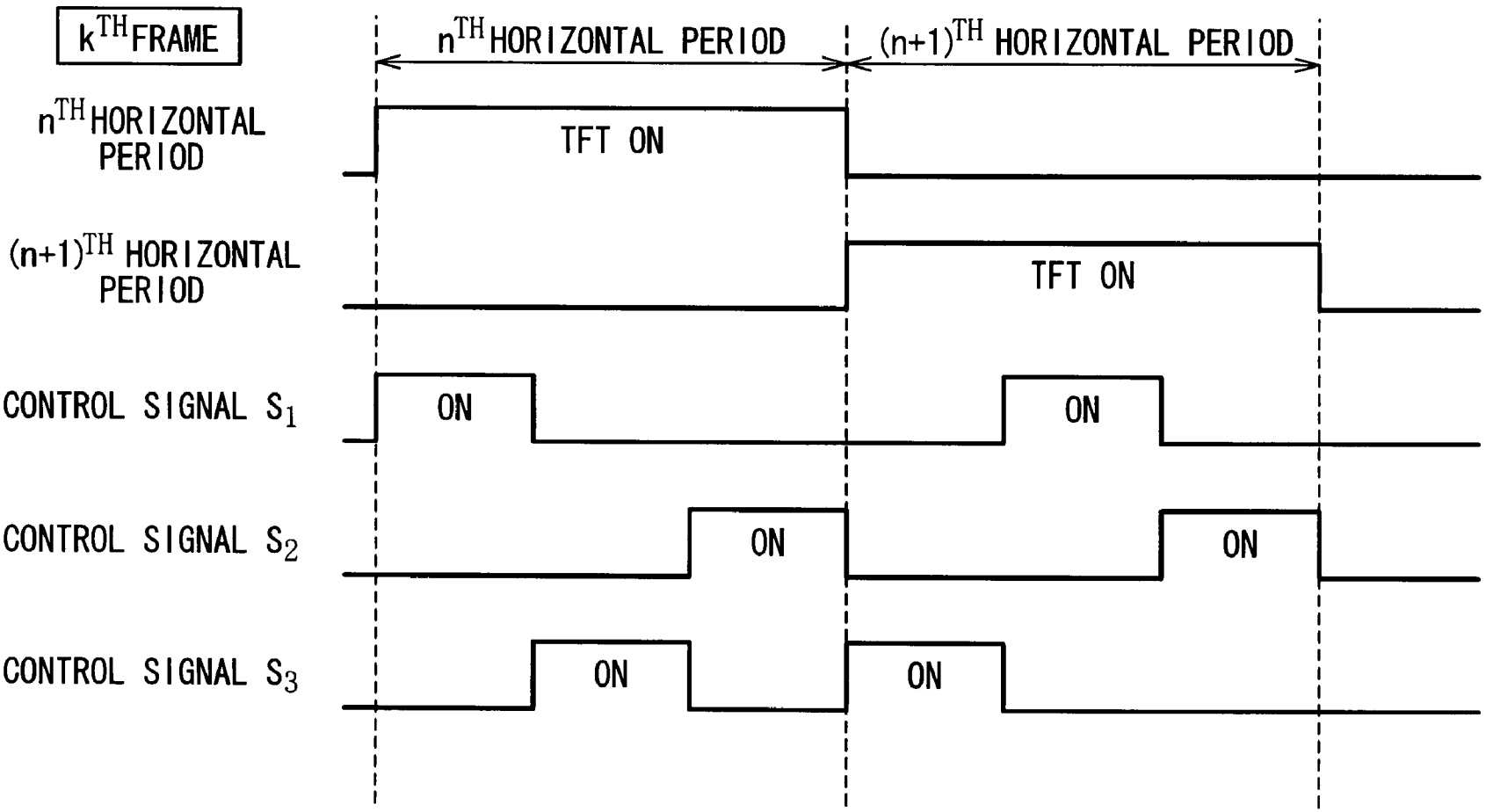
FIG. 17A is a timing chart showing the waveforms of signals to be supplied to the liquid crystal display panel according to the display panel driving method of the third embodiment.
Figure 17B:
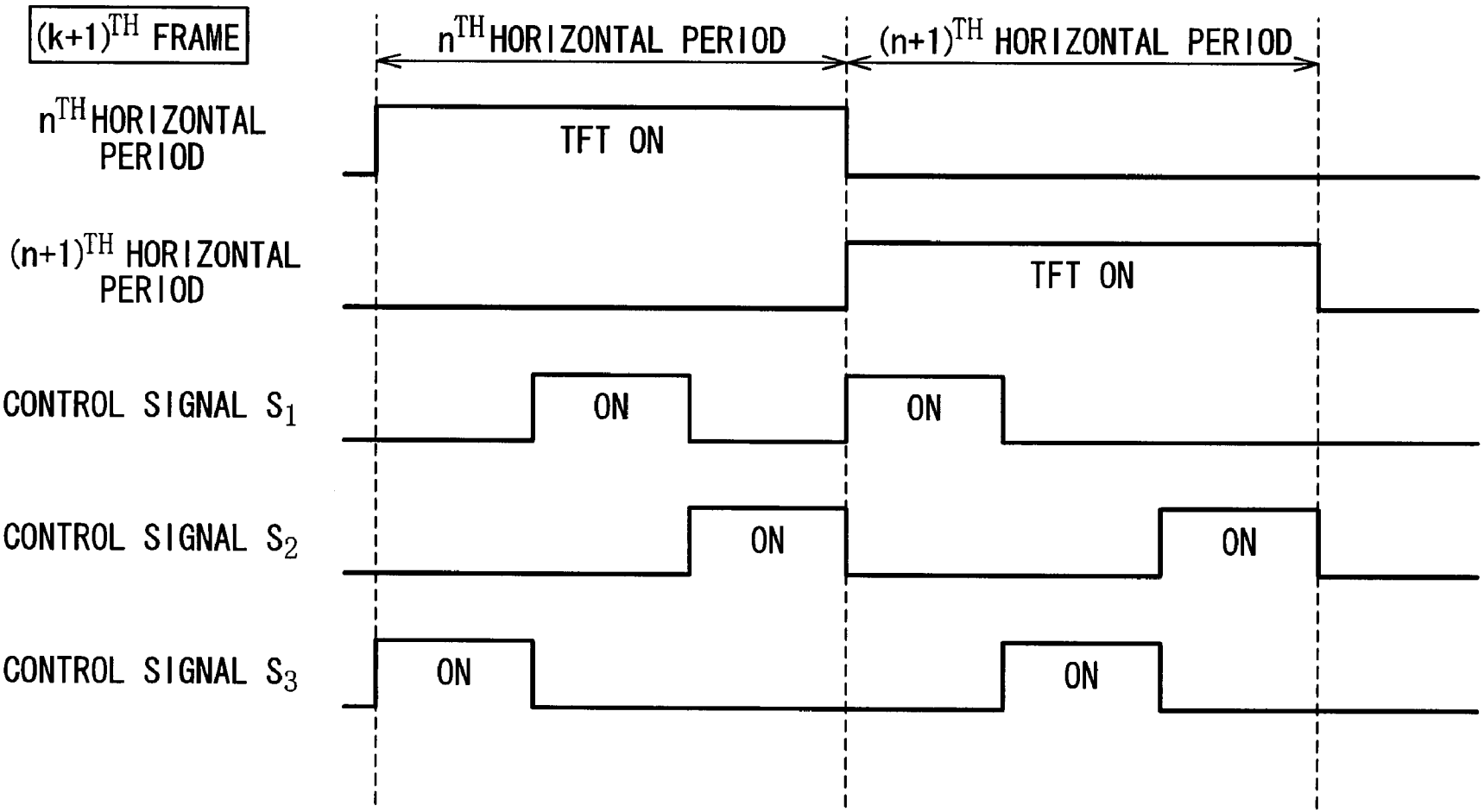
FIG. 17B is a timing chart showing the waveforms of signals to be supplied to the liquid crystal display panel according to the display panel driving method of the third embodiment.

FIGS. 17A and 17B are timing charts showing the waveforms of signals received by the liquid crystal panel 10' adapted to provide a frame rate control. For the drive of the pixels positioned in the $n^{th}$ line during the $k^{th}$ frame, the control signals $S_1$, $S_3$, and $S_2$ are activated in this order. For the drive of the pixels positioned in the $(n+1)^{th}$ line during the $k^{th}$ frame, the control signals $S_3$, $S_1$, and $S_2$ are activated in this order.

For the drive of the pixels positioned in the $n^{th}$ line during the $(k+1)^{th}$ frame, on the other hand, the control signals $S_1$, to $S_3$ are activated in the same order as that for the pixels positioned the $(n+1)^{th}$ line during the $k^{th}$ frame, that is, in this order of the control signals $S_3$, $S_1$, and $S_2$. For the drive of the pixels positioned in the $(n+1)^{th}$ line during the $(k+1)^{th}$ frame, the control signals $S_1$ to $S_3$ are activated in the same order as that for the pixels positioned in the $n^{th}$ line during the $k^{th}$ frame, that is, in this order of control signals $S_1$, $S_3$ and $S_2$. As the control signals $S_1$ to $S_3$ are activated in the above described sequence, the drive of the pixels within each pixel set can be switched from one frame to another.

It is apparent that the present invention is not limited to the above-described embodiments, which may be modified and changed without departing from the scope of the invention.

What is claimed is:

1. A method of driving a display panel including:

N×3 pixels arranged along each of a plurality of lines extending in a scanning line direction with N being an integer equal to or more than 2, said N×3 pixels constituting first to $N^{th}$ pixel sets each comprising an R pixel associated with red, a G pixel associated with green, and a B pixel associated with blue, said method comprising:

time-divisionally driving said N×3 pixels positioned in each of said plurality of lines during a specific frame, wherein a drive sequence of an $n^{th}$ line out of said plurality of lines is different from that of an $(n+1)^{th}$ line out of said plurality of lines, said $(n+1)^{th}$ line being adjacent to said $n^{th}$ line, and wherein said G pixels, each included within associated one of said first to $N^{th}$ pixels sets, are driven $(N+1)^{th}$ earliest or later for each of said $n^{th}$ and $(n+1)^{th}$ line, wherein drive sequences of said lines are cycled at a line cycle of M lines, wherein said R pixels are arranged in columns, wherein said R, G, and B pixels are assigned with ordinal numbers indicative of a drive sequence of each of said plurality of lines, wherein ordinal numbers of said R pixels positioned in the same column are different from each other over each line cycle, wherein said B pixels are arranged in columns, wherein ordinal numbers of said B pixels positioned in the same column are different from each other over each line cycle, wherein N is 2K with K being an integer equal to or more than 2, wherein G pixels within odd-numbered ones of said first to $n^{th}$ pixel sets positioned in said $n^{th}$ line are assigned with ordinal numbers selected out of the first half of ordinal numbers assigned with said G pixels within said first to $n^{th}$ pixel sets, and determined as being incremental in a predetermined direction along said scanning line direction, wherein G pixels within even-numbered ones of said first to $n^{th}$ pixel sets positioned in said $n^{th}$ line are assigned with ordinal numbers selected out of the second half of said ordinal numbers assigned with said G pixels within said first to $n^{th}$ pixel sets, and determined as being incremental in said predetermined direction, wherein G pixels within odd-numbered ones of said first to $n^{th}$ pixel sets positioned in said $(n+1)^{th}$ line are assigned with ordinal numbers selected out of the second half of said ordinal numbers assigned with said G pixels within said first to $n^{th}$ pixel sets, and determined as being decremental in said predetermined direction, wherein G pixels within even-numbered ones of said first to $n^{th}$ pixel sets positioned in said $(n+1)^{th}$ line are assigned with ordinal numbers selected out of the first half of said ordinal numbers assigned with said G pixels within said first to $n^{th}$ pixel sets, and determined as being decremental in said predetermined direction, wherein R and B pixels within odd-numbered ones of said first to $n^{th}$ pixel sets positioned in said $n^{th}$ line are assigned with ordinal numbers selected out of the first half of ordinal numbers assigned with said R and B pixels within said first to $n^{th}$ pixel sets, and determined as being incremental in a predetermined direction along said scanning line direction, wherein R and B pixels within even-numbered ones of said first to $n^{th}$ pixel sets positioned in said $n^{th}$ line are assigned with ordinal numbers selected out of the second half of said ordinal numbers assigned with said R and B pixels within said first to $n^{th}$ pixel sets, and determined as being incremental in said predetermined direction, wherein R and B pixels within odd-numbered ones of said first to $n^{th}$ pixel sets positioned in said $(n+1)^{th}$ line are assigned with ordinal numbers selected out of the second half of said ordinal numbers assigned with said R and B pixels within said first to $n^{th}$ pixel sets, and determined as being decremental in said predetermined direction, and wherein R and B pixels within even-numbered ones of said first to $n^{th}$ pixel sets positioned in said $(n+1)^{th}$ line are assigned with ordinal numbers selected out of the first half of said ordinal numbers assigned with said R and B pixels within said first to $n^{th}$ pixel sets, and determined as being decremental in said predetermined direction.

2. The method according to claim 1, wherein said display panel includes:

an input node connected to an amplifier, and

N×3 switches connected between said input node and said N×3 pixels, respectively, wherein said driving said N×3 pixels positioned in said $n^{th}$ line involves sequentially providing drive voltages associated with said N×3 pixels positioned in said $n^{th}$ line on said input node, and sequentially turning on said N×3 switches as timed with said providing said drive voltages, and wherein said driving said N×3 pixels positioned in said $(n+1)^{th}$ line involves sequentially providing drive voltages associated with said N×3 pixels positioned in said $(n+1)^{th}$ line, respectively, on said input node, and sequentially turning on said N×3 switches as timed with said providing said drive voltages.

3. The method according to claim 1, wherein said G pixels are driven $(2N+1)^{th}$ earliest or later for each of said $n^{th}$ and $(n+1)^{th}$ lines.

4. The method according to claim 1, wherein said G pixels are driven $(n+1)^{th}$ to $(2N)^{th}$ earliest for each of said $n^{th}$ and $(n+1)^{th}$ lines.

5. The method according to claim 1, wherein an ordinal number of each of said N×3 pixels positioned in said $n^{th}$ line are different from that of corresponding one of said N×3 pixels positioned in said $(n+1)^{th}$ line.

6. The method according to claim 1, wherein sums of said ordinal numbers of said R and B pixels in the same columns over each line cycle are constant.

7. The method according to claim 1, wherein said line cycle is 2N (=4K) lines, wherein drive sequences of $(n+2)^{th}$ to $(n+N-1)^{th}$ lines out of said plurality of lines are determined so that drive sequences of $(n+2p)^{th}$ and $(n+2p+1)^{th}$ lines are respectively identical to drive sequences of $(n+2p-2)^{th}$ and $(n+2p-1)^{th}$ lines having relevant ordinal numbers cyclically shifted in said scanning line direction by two pixel sets, for p being any integer of 1 to K−1, wherein ordinal numbers of G pixels positioned in $(n+N)^{th}$ and $(n+N+1)^{th}$ lines out of said plurality of lines are determined as being identical to those positioned in $n^{th}$ and $(n+1)^{th}$ lines, wherein ordinal numbers of R and B pixels positioned in $(n+N)^{th}$ and $(n+N+1)^{th}$ lines out of said plurality of lines are determined through exchanging ordinal numbers of R and B pixels positioned in $n^{th}$ and $(n+1)^{th}$ lines between said odd-numbered ones of said first to $N^{th}$ pixel sets and said even-numbered ones of said first to $N^{th}$ pixel sets, wherein drive sequences of $(n+N+2)^{th}$ to $(n+2N-1)^{th}$ lines out of said plurality of lines are determined so that drive sequences of $(n+N+2p)^{th}$ and $(n+N+2p+1)$ lines are respectively identical to drive sequences of $(n+N+2p-2)^{th}$ and $(n+N+2p-1)^{th}$ lines having relevant ordinal numbers cyclically shifted in said scanning line direction by two pixel sets, for p being any integer of 1 to K−1.

8. The method according to claim 1, further comprising:

time-divisionally driving said N×3 pixels positioned in each of said plurality of lines during another frame following said specific frame, wherein a drive sequence of said $n^{th}$ line for said following frame is different from that of said $n^{th}$ line for said specific frame, and wherein a drive sequence of said $(n+1)^{th}$ line for said following frame is different from that of said $(n+1)^{th}$ line for said specific frame.

9. The method according to claim 8, wherein drive sequences are temporally cycled at a frame rate control period, and wherein a sum of ordinal numbers of each of R and B pixels over each frame rate control period are constant.

* * * * *